US011009240B2

(12) United States Patent
Ma

(10) Patent No.: US 11,009,240 B2
(45) Date of Patent: May 18, 2021

(54) AIR CONDITIONER

(71) Applicant: Shenzhen KEKU Technology Co., Ltd., Shenzhen (CN)

(72) Inventor: Zelei Ma, Shenzhen (CN)

(73) Assignee: SHENZHEN KEKU TECHNOLOGY CO., LTD., Shenzhen (CN)

( * ) Notice: Subject to any disclaimer, the term of this patent is extended or adjusted under 35 U.S.C. 154(b) by 72 days.

(21) Appl. No.: 16/403,810

(22) Filed: May 6, 2019

(65) Prior Publication Data

US 2020/0309391 A1 Oct. 1, 2020

(30) Foreign Application Priority Data

Apr. 1, 2019 (CN) ..... 201920433767.1
Apr. 30, 2019 (CN) ..... 201910363311.7

(51) Int. Cl.
*F24F 1/04* (2011.01)
*F24F 1/028* (2019.01)
(Continued)

(52) U.S. Cl.
CPC ..... *F24F 1/04* (2013.01); *F24F 1/022* (2013.01); *F24F 1/028* (2019.02); *F25B 13/00* (2013.01)

(58) Field of Classification Search
CPC .... F24F 2221/12; F24F 2221/125; F24F 1/04; F24F 1/022; F24F 1/0232; F24F 1/039;
(Continued)

(56) References Cited

U.S. PATENT DOCUMENTS 8,522,565 B1 * 9/2013 Hauck ..... F25D 19/02 62/115
2006/0093494 A1 * 5/2006 Kitaichi ..... F01C 21/007 417/415

(Continued)

FOREIGN PATENT DOCUMENTS

CN 201439970 U 4/2010
CN 104676775 A 6/2015

(Continued)

OTHER PUBLICATIONS

International Search Report in PCT/CN2020/081477 dated Jun. 22, 2020, 5 pages.

(Continued)

*Primary Examiner* — David J Teitelbaum
(74) *Attorney, Agent, or Firm* — Metis IP LLC

(57) ABSTRACT

An air conditioner may be provided. The air conditioner may include a housing disposed on a base, the housing may house an evaporator unit, a condenser unit, and a compressor unit. A first air inlet and a first air outlet may be located on a first end of the housing. The first air inlet, the first air outlet and the evaporator may be connected to each other to form an internal air circulation system. A second air inlet and a second air outlet may be located on a second end of the housing. The second air inlet, the second air outlet and the condenser unit may be connected to each other to form an external air circulation system. Airways of the internal air circulation system and the external air circulation system may be independent from each other.

20 Claims, 12 Drawing Sheets

(51) Int. Cl.
*F24F 1/022* (2019.01)
*F25B 13/00* (2006.01)

(58) Field of Classification Search
CPC .... F24F 1/03; F24F 1/02; F24F 1/0007; F24F 1/0059
See application file for complete search history.

(56) References Cited

U.S. PATENT DOCUMENTS

| | | | | |
|---|---|---|---|---|
| 2007/0163278 | A1* | 7/2007 | Hung | F24F 11/0008 62/176.5 |
| 2010/0050682 | A1* | 3/2010 | Ariga | F24F 1/04 62/401 |
| 2015/0060622 | A1 | 3/2015 | Yeh et al. | |

FOREIGN PATENT DOCUMENTS

| | | | |
|---|---|---|---|
| CN | 105841252 | A | 8/2016 |
| CN | 106500200 | A | 3/2017 |
| CN | 107461831 | A | 12/2017 |
| CN | 206905176 | U | 1/2018 |
| CN | 108534247 | A | 9/2018 |
| CN | 108917020 | A | 11/2018 |
| CN | 208059138 | U | 11/2018 |
| CN | 210153960 | U | 3/2020 |

OTHER PUBLICATIONS

Written Opinion in PCT/CN2020/081477 dated Jun. 22, 2020, 6 pages.

* cited by examiner

AIR CONDITIONER

CROSS-REFERENCE TO RELATED APPLICATIONS

This application claims priority of Chinese Patent Application No. CN 201920433767.1, filed on Apr. 1, 2019, and Chinese Patent Application No. CN 201910363311.7, filed on Apr. 30, 2019, the entire contents of which are hereby incorporated by reference.

TECHNICAL FIELD

The present disclosure generally relates to air conditioner, and in particular, to a portable air conditioner.

BACKGROUND

A traditional air conditioner is a big bulk, and only be powered by the utility power. It thus is inconvenient for the use in outdoor environment, for example, a construction site, camping site. To meet people's desire to use an air conditioner to adjust surrounding ambient temperature in an outdoor activity, there exist portable air conditioners on the market. The portable air conditioners are easily moved and carried at any time. The common portable air conditioners may include a casing, a base, an evaporator (or a cooler), a condenser (or a heat sink), a compressor, an air inlet, an air outlet, and so on. The evaporator, the condenser and the compressor may be connected through a circulation pipe. However, the common portable air conditioners on the market still have many shortcomings to be improved. For example, an air outlet of the air conditioners is disposed at the front end of the casing, an exhaust outlet of the air conditioners is disposed at the rear end of the casing, and the air inlet is disposed at a side of the casing. In such a design, air may enter the casing from the air inlets on two sides, then get cooled in the evaporator and finally, the cooled air may be sent out from the air outlet. In some cases, this design easily causes some issues. For example, the air enters from a side and then leaks from the side. As another example, the cooled air is directly sucked into the air inlet and exchange heat with the condenser, then the cooled air is discharged, which may cause irregularity of the air circulation. As a further example, if an internal air circulation and an external air circulation are not independent, it may reduce the efficiency of an air heat exchange and utilization rate, and may also reduce the cooling efficiency of the air conditioner. In some cases, when using the common air conditioner, at least one part of the air inlet may need to be placed indoor, and at least one part of the air outlet is placed outdoor, so it is not convenient to install the air conditioner. Moreover, for a portable air conditioner, a drainage system for discharging condensed water is needed, which may require a large space for installing the air conditioner, and make internal structures of the air conditioner more complicated, resulting in the inconvenience to move and carry.

SUMMARY

In one aspect, an air conditioner may be provided. The air conditioner may have a housing disposed on a base. The housing may house an evaporator unit, a condenser unit, and a compressor unit. A first air inlet and a first air outlet may be located on a first end of the housing, and the first air inlet, the first air outlet and the evaporator may be connected to each other to form an internal air circulation system. A second air inlet and a second air outlet may be located on a second end of the housing, and the second air inlet, the second air outlet and the condenser unit may be connected to each other to form an external air circulation system. Airways of the internal air circulation system and the external air circulation system may be independent from each other. The second end may be opposite to the first end.

In some embodiments, the evaporator unit may be disposed at an end of the first air inlet or the first air outlet at the first end of the housing, and the condenser unit may be disposed at an end of the second air inlet or the second air outlet at the second end of the housing.

In some embodiments, the second air inlet and the second air outlet may be juxtaposed, and the condenser unit may be disposed between the second air inlet and the second air outlet. The first air inlet and the first air outlet may be juxtaposed, the first air outlet being disposed above the first air inlet at an obliquely upward position relative to the first air inlet.

In some embodiments, a water stirring unit may be disposed inside the housing. A first mounting groove may be configured to mount the evaporator unit, a second mounting groove be configured to mount the condenser unit. The first mounting groove and the second mounting groove may be disposed on an inner bottom of the housing. A guiding groove or a guiding tube, disposed at one end of the first mounting groove, which may discharge condensed water to the second mounting groove. When a refrigerant absorbs heat from air inside the evaporator unit, water vapor in the air may be condensed to form the condensed water. The water stirring unit may be disposed in the second mounting groove and under the condenser unit. The water stirring unit may be configured to stirring the condensed water in the second mounting groove to form water beads, and spray the water beads to the condenser unit. The condenser unit may discharge the water beads to the external air circulation system In some embodiments, the water stirring unit may include a driving mechanism connectedly to drive a water wheel to rotate. The water wheel may be disposed in the second mounting groove.

In some embodiments, the evaporator unit may include an evaporator and a first centrifugal fan, the evaporator being positioned in the first mounting groove corresponding to the first air outlet, and the first centrifugal fan being disposed between the evaporator and the compressor unit.

In some embodiments, the first centrifugal fan may include a first casing and a first impeller disposed in the first casing. The first casing may include an air inlet end and an air outlet end. The air inlet end may be connected to the first air inlet, and the air outlet end may be connected to the first air outlet. The air outlet end is opposite to the evaporator.

In some embodiments, the condenser unit may include a condenser disposed in the second mounting groove and a second centrifugal fan, the condenser and the second centrifugal fan being juxtaposed.

In some embodiments, the second centrifugal fan may include a second casing, a third casing connected to the second casing, and a second impeller disposed in the third casing. The second casing and the third casing may be disposed inside the housing side by side. An air inlet end may be formed on an inner side of the second casing. An air outlet end may be formed on an inner side of the third casing. The second casing may be connected to the second air inlet. The third casing may be connected to the second air outlet. The condenser may be disposed between the air inlet end of the second casing and the air outlet end of the third casing, and the water stirring unit may be disposed on a bottom of the condenser.

In some embodiments, the compressor unit may include a direct current (DC) variable frequency double cylinder rotor compressor.

In some embodiments, the base may include a DC battery pack for supplying power to the evaporator unit, the condenser unit, and the compressor unit.

In some embodiments, the DC battery pack may be connected to a charge-discharge interface disposed on a side of the base. The charge-discharge interface may be connected to an external power source for charging, or may be connected to a power supply interface for supplying power for the evaporator unit, the condenser unit, and the compressor unit. The power supply interface may be disposed on a side of the bottom of the housing.

In some embodiments, an operating voltage of the DC battery pack may be 24V.

In some embodiments, a control panel may be disposed on the housing. An integrated control system being integrated to the control panel and the DC battery pack may be electrically connected to the integrated control system and supplies power for the integrated control system. The evaporator unit, the condenser unit, and the compressor unit may be electrically connected to the control panel.

In some embodiments, the evaporator unit further may include a temperature and humidity sensing system. The temperature and humidity sensing system may at least include a temperature sensor and a humidity sensor, and the temperature sensor and the humidity sensor may be connected to the integrated control system signally.

In some embodiments, the temperature sensor may include a first temperature sensor and a second temperature sensor. The first temperature sensor and the humidity sensor may be disposed inside the first air inlet. The second temperature sensor may be disposed inside the first air outlet. A temperature display module, disposed in a middle portion of the first air outlet and connected to the integrated control system signally, may be configured to display a temperature detected by the second temperature sensor.

In some embodiments, the bottom of the housing may include a snapping holder and a snapping connector connected to the snapping holder. An upper portion of the base may include a sliding groove paired with the snapping holder, and a bottom of the sliding groove includes a receiving portion coupled to the snapping connector. The housing may be detachably coupled to the base by using the snapping connector and the receiving portion.

In some embodiments, the snapping connector may include a snapping plate coupled to the snapping holder, and a snapping portion attached to a side of the snapping plate, the snapping portion snappily connecting to the receiving portion.

In some embodiments, the snapping holder may be open on the side and concavely formed with an open groove. The snapping holder may include a notch at a bottom of the open groove. The snapping plate may be inserted into the open groove through a side opening of the snapping holder, and the snapping portion may be protruded from the notch.

In some embodiments, the air conditioner may include a positioning clamping assembly for positioning and clamping the housing and the base. The positioning clamping assembly may include a positioning groove disposed on the bottom of the housing, and an adjustable positioning assembly disposed on the base. The adjustable positioning assembly may include a positioning block, an adjustment plate, and a torsion spring assembly for connecting the positioning block and the adjustment plate. The positioning block may be disposed at an upper portion of the base, and extended out of or retracted into interior of the base for engaging with the positioning groove to achieve clamping or disengagement from the positioning groove to release the clamping. The adjustment plate may be disposed on a second side of the base, and pushed up and down to drive the positioning block into the interior of the base. The torsion spring assembly may be configured to connect the positioning block and the adjustment plate for implementing the linkage of the positioning block and the adjustment plate, and providing a clamping force for the positioning block and the positioning groove to achieve clamping.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
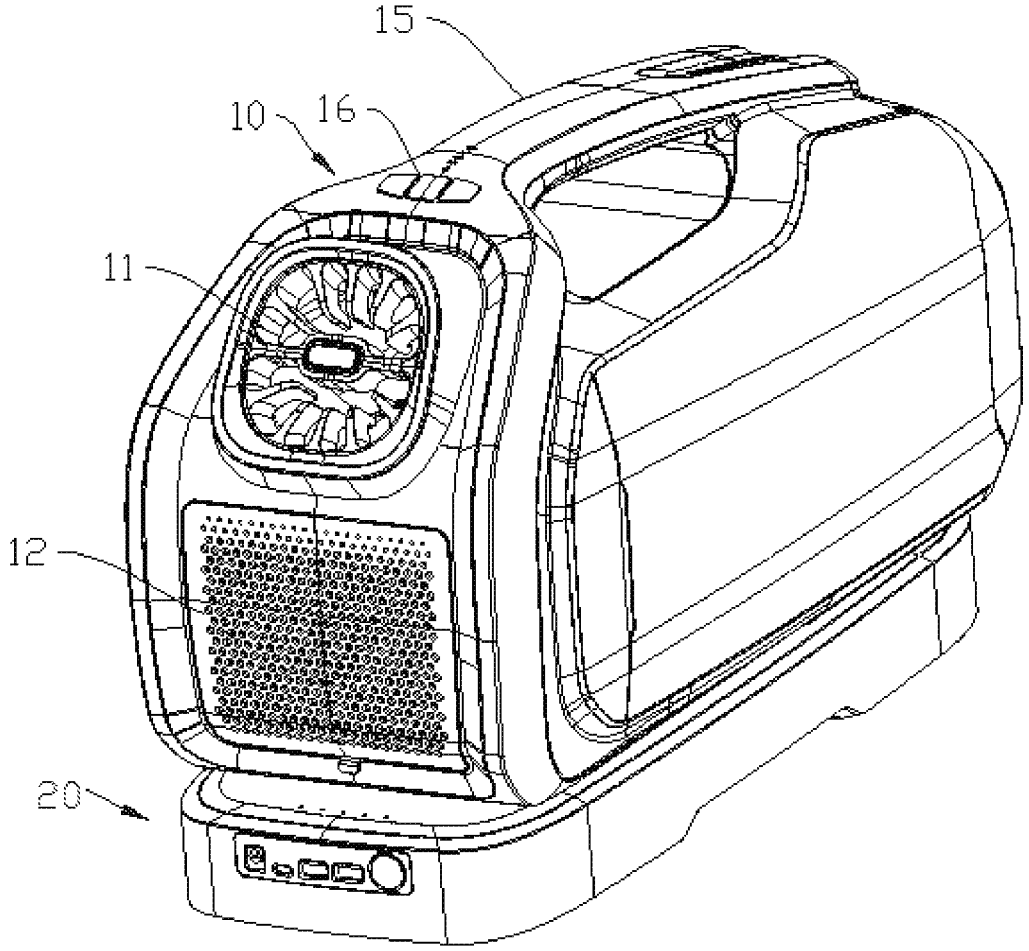
FIG. 1 is a schematic diagram illustrating a first structure of an air conditioner according to some embodiments of the present disclosure.

In order to illustrate the technical solutions related to the embodiments of the present disclosure, brief introduction of the drawings referred to the description of the embodiments is provided below. Obviously, drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to same structure or process.

It should be understood that, terms such as "system," "device," "unit", or the like, as used herein, are used to distinguish different modules, elements, components, parts or assemblies of different levels. However, if other words can achieve the same purpose, the terms can be replaced by other words.

As used in the disclosure and the appended claims, the singular forms "a," "an," and "the" include plural referents unless the content clearly indicates otherwise. In general, the terms "comprise" and "include" merely prompt to include steps and elements that have been clearly identified, and these steps and elements do not constitute an exclusive listing. The methods or devices may also include other steps or elements.

The flowcharts used in the present disclosure may illustrate operations that the systems may implement according to some embodiments of the present disclosure. It is to be expressly understood, the operations above or below may or may not be implemented in order. Instead, the operations may be processed in reverse order or simultaneously. Besides, one or more other operations may be added to the flow charts, or one or more operations may be omitted from the flow chart.

Figure 2:
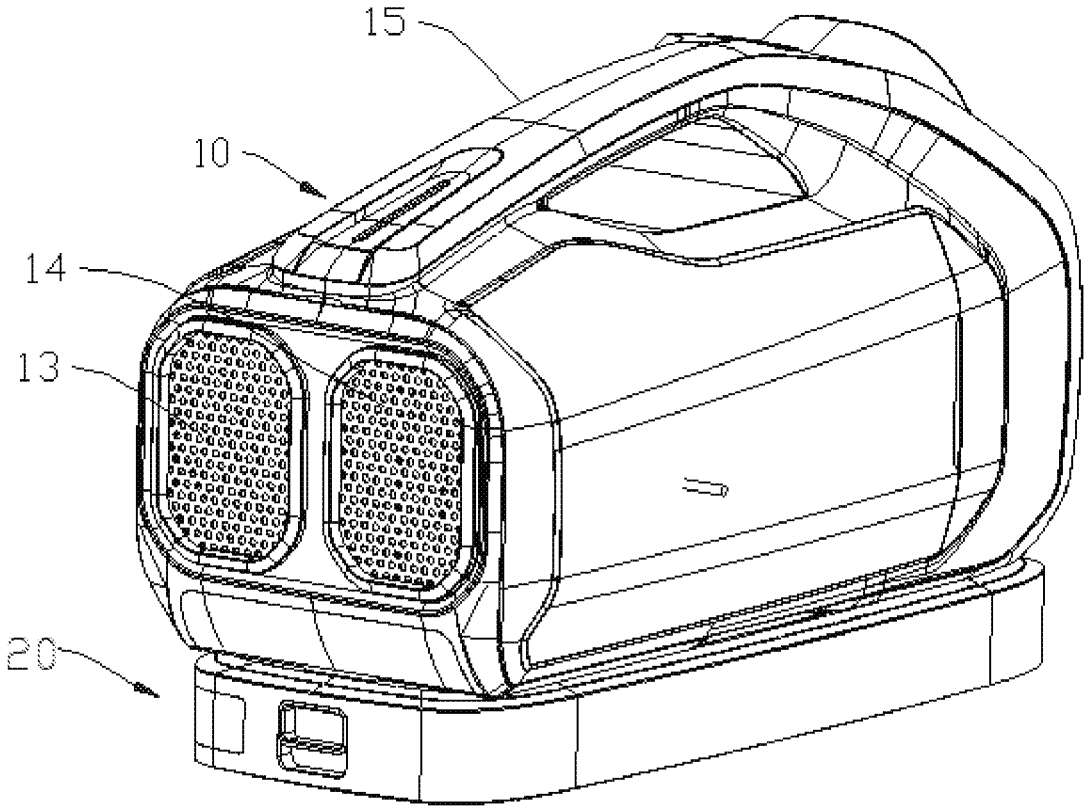
FIG. 2 is a schematic diagram illustrating a second structure of an air conditioner according to some embodiments of the present disclosure.
Figure 3:
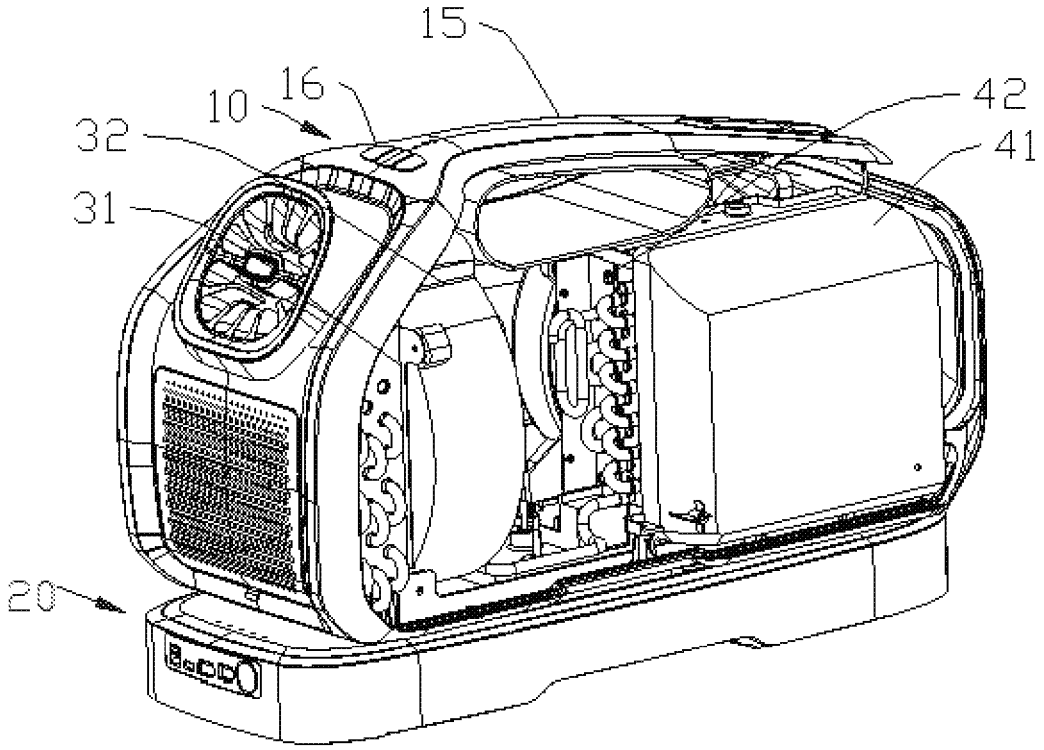
FIG. 3 is a partial cross-sectional view of an air conditioner according to some embodiments of the present disclosure.

FIG. 1 illustrates a first structure of an air conditioner according to some embodiments of the present disclosure. FIG. 2 illustrates a second structure of the air conditioner according to some embodiments of the present disclosure. FIG. 3 illustrates a partial cross-sectional view of the air conditioner according to some embodiments of the present disclosure. As shown in FIGS. 1-3, the air conditioner may include a housing 10, a base 20 positioned at a bottom of the housing 10. In some embodiments, there exist an evaporator unit 30, a condenser unit 40, and a compressor unit 50 (shown in FIG. 4) in the housing 10. In some embodiments, the housing 10 may include a first air inlet 11 and a first air outlet 12. The first air inlet 11, the first air outlet 12 and the evaporator unit 30 may be connected to each other to form an internal air circulation system. In some embodiments, the housing 10 may further include a second air inlet 13 and a second air outlet 14. The second air inlet 13, the second air outlet 14 and the condenser unit 40 may be connected to each other to form an external air circulation system. The internal air circulation system and the external air circulation system may be independent from each other. The first air inlet 11 and the first air outlet 12 may be located on a first end of the housing 10. The second air inlet 13 and the second air outlet 14 may be located on a second end of the housing 10. In some embodiments, the second end is opposite to the first end.

As described above, the air conditioner includes the housing 10, the base 20 disposed on the bottom of the housing 10, the evaporator unit 30, the condenser unit 40, and the compressor unit 50 disposed inside the housing 10. This air conditioner may have a small volume, a light weight, so it is easy for a user to carry, utilize and/or place the air conditioner. The air conditioner may have a better cooling effect and heat dissipation effect. The air conditioner may be used in various scenarios, for example, a small space (e.g., a tent, a temporary board house, a car, etc.), a public place (e.g., an office, an open workshop, etc.), a frequently moving place (e.g., an outdoor temporary command center, a site office, a military camp, etc.), a place with high precision requirements (e.g., a machine room, an equipment instrument room, etc.), a rarely used room (e.g., a rarely used meeting room), a place that is not convenient to mount a fixed air conditioner (e.g., a kitchen, a storage room, etc.), a room for frequently relocating or renting, a construction site or a mine, etc.

In some embodiments, the air conditioner may include the internal air circulation system and the external air circulation system. Airways of the internal air circulation system and the external air circulation system may be independent from each other. When the air conditioner performs cooling operations, air to be cooled may enter the air conditioner from the first air inlet 11 of the internal circulation system, then the evaporator unit 30 may take away heat of the air to get cooled air. The cooled air may be blown out from the first air outlet 12 of the internal air circulation system. The external air (e.g., outdoor air) may enter the air conditioner from the second air inlet 13 of the external circulation system, then the condenser unit 40 may take away the heat generated during the condensation process. The cooled air may be blown out from the second air outlet 14 of the external circulation system. The air conditioner may perform cycle refrigeration. In some embodiments, the internal air circulation system and the external air circulation system are independent from each other, which may enable the air conditioner to completely use the external air to dissipate heat, prevent indoor air from being continuously discharged to the outdoor, and ensure a regular circulation of the indoor air. Thereby the cooling effect and heat dissipation effect may be improved, and the issues that irregular air circulation and poor cooling effect may be reduced or avoided.

In some embodiments, the first air inlet 11 of the internal air circulation system and the first air outlet 12 may be located on one end of the housing 10 (e.g., a first end of the housing 10). The second air inlet 13 and the second air outlet 14 of the outer circulation system may be located on the other end of the housing 10 (e.g., a second end of the housing 10). In some embodiments, the first end may be opposite to the second end. This design may shorten paths that the air of the internal air circulation and the external air circulation from enter to blow out, thereby improve the cooling efficiency and heat dissipation efficiency. The air conditioner may also be placed conveniently. For example, the user may just need to place the end (e.g., the second end) including the second air inlet 13 and the second air outlet 14 to the outdoor.

In some embodiments, the compressor unit 50 may be connected to a circulation channel for a refrigerant cycle. The condenser unit 40 and the evaporator unit 30 may be successively wound on the circulation channel along a direction of the refrigerant cycle. The refrigerant may absorb heat from air inside the evaporator unit 30. The refrigerant may be pressurized and driven by the compressor unit 50, and be sent to the condenser unit 40. The condenser unit 40 may absorb heat in the refrigerant. Specifically, the evaporator unit 30 may be used for heat dissipation. The refrigerant and the evaporator unit 30 may perform heat exchange, and the heat from air inside the evaporator unit 30 may be taken away. After pressurized by the compressor unit 50, the refrigerant may be sent to the condenser unit 40 through the circulation channel. The condenser unit 40 may be configured to absorb the heat (via the heat exchange) in the refrigerant outputted by the compressor unit 50. After the condenser unit 40 performs condensation operation for the refrigerant, the compressor unit 50 may compress the refrigerant and send the refrigerant to the evaporator unit 30 through the circulation channel. In some embodiments, the compressor unit 50 may be used for refrigerant pressurization and compression, and provide a driving power for refrigerant transmission and circulation. In some embodiments, the refrigerant may include ammonia, Freon (e.g., Freon-12, Freon-22, etc.), water, hydrocarbons, or the like, or any combination thereof.

In some embodiments, the airway refers to a channel for air movement and air circulation. The airway of the internal air circulation system may include one or more connection channels among the first air inlet 11, the first air outlet 12 and the evaporator unit 30. The airway of the external circulation system may include one or more connection channels among the second air inlet 13, the second air outlet 14 and the condenser unit 40. The internal air circulation system and the outer circulation system may be independent from each other due to the independent airways. The internal air circulation system may cool indoor air and discharge the cooled air to the room. The external air circulation system may take heat to the outdoor. The air inlets and the air outlets of the internal circulation system and the external circulation system may be respectively disposed at two ends of the housing 10. The internal air circulation system and the external air circulation system may be independent circulation systems, and not affect each other. Therefore, the cooling efficiency and heat dissipation efficiency may be improved.

In some embodiments, the evaporator unit 30, the condenser unit 40, and the compressor unit 50 may be disposed on the inner bottom of the housing 10 by various connection means, for example, a clamping connection (e.g., a ring-shaped clamping, a cantilever clamping, a twisting clamping, etc.), a riveting connection (e.g., a fixed riveting, a movable riveting, etc.), a threaded connection (e.g., a bolted connection, a screw connection, a self-tapping screw, a fastener-assembly connection, etc.), a flexible connection (e.g., a spring connection, a flexible shaft connection, a bonding, etc.), a removable connection (e.g., a sliding connection, a rolling connection, etc.), a pin connection, a welding connection, a fastening connection, and so on. In some embodiments, the first air inlet 11, the first air outlet 12, the second air inlet 13 and the second air outlet 14 may include a filtering structure (e.g., a filter net) for filtering dust, small insects or other impurities that enable to enter channels through the air inlet and/or air outlet. In some embodiments, the air conditioner may include a flapper at the first air outlet 12. The wind direction blown from the first air outlet 12 may be changed by adjusting the flapper. In some embodiments, the housing 10 may include a holder/a handle 15 in order to facilitate carrying or moving the air conditioner. In some embodiments, a button 16 may be disposed on the holder or handle 15 in order to facilitate controlling the air conditioner to be turned on or turn off. In some embodiments, the button 16 may be not disposed on the holder or the handle 15. The button 16 may be disposed on any position of the housing 10, for example, the first end or a side of the housing 10. In some embodiments, the housing 10 may be an integrally formed structure, which is a closed whole body. The evaporator unit 30, the condenser unit 40, and the compressor unit 50 may be fixed to the inner bottom of the housing 10 by various means (e.g., a bonding, a fastening), so as to provide a good seal effect. In some embodiments, the housing 10 may be a combination of two symmetrically matched housings. The evaporator unit 30, the condenser unit 40, and the compressor unit 50 may be arranged on the inner bottom of the housing 10 by various means (e.g., a snapping, a screwing). The internal electrical components of the air conditioner may be easily installed and removed. In some embodiments, the housing 10 may also include a removable cover and a housing support coupled to the cover. The evaporator unit 30, the condenser unit 40 and the compressor unit 50 may be disposed on the housing support connected to the cover by attaching, bonding, or screwing.

In some embodiments, the first air inlet 11 and the first air outlet 12 may be disposed at the first end of the housing 10. The second air inlet 13 and the second air outlet 14 may be disposed at the second end of the housing 10. The first end may be opposite to the second end.

Locations of the first air inlet 11, the first air outlet 12, the second air inlet 13, and the second air outlet 14 may be designed aimed at facilitating placing the air conditioner. For example, the end including the first air inlet 11 and the first air outlet 12 may be placed inside a specific space (e.g., a tent). The end including the second air inlet 13 and the second air outlet 14 may be placed outside the specific space. When placing the air conditioner, only the end including second air inlet 13 and the second air outlet 14 need to be placed outside the space. Most components of the air conditioner may be placed inside the space. It is convenient for the indoor user to operate the air conditioner. The user's experience may be improved. The problem that the inconvenience caused by the air outlets disposed at the side of the common air conditioner may be resolved.

In some embodiments, the evaporator unit 30 and the condenser unit 40 may be respectively disposed at two ends of the housing 10. The evaporator unit 30 may be disposed at the first end of the housing 10, which the first air inlet 11 or the first air outlet 12 is located at. The condenser unit 40 may be disposed at the second end of the housing 10, which the second air inlet 13 or the second air outlet 14 is located at. Because the first air inlet 11, the first air outlet 12, and the evaporator unit 30 may be disposed on the same side, the path from the first air inlet 11 to the evaporator unit 30 and the path from the evaporator unit 30 to the first air outlet 12 may be shortened. The paths of the air circulation may be shorten accordingly. Thereby the cooling efficiency may be improved. Similarly, because the second air inlet 13, the second air outlet 14 and the condenser unit 40 may also be disposed on the same side, the path from the second air inlet 13 to the condenser unit 40 and the path from the condenser unit 40 to the second air outlet 14 may be shortened. The paths of the air circulation may be shortened accordingly. Thereby the heat exchange efficiency may be improved. It may resolve problems that the paths of the air circulation are long and complicated in the common air conditioner.

In some embodiments, the second air inlet 13 and the second air outlet 14 may be juxtaposed. The condenser unit 40 may be disposed between the second air inlet 13 and the second air outlet 14.

In some embodiments, the second air inlet 13 and the second air outlet 14 may be juxtaposed. The condenser unit 40 may be disposed in the channel between the second air inlet 13 and the second air outlet 14, which may facilitate air circulation and heat dissipation, and improve the heat dissipation efficiency. In some embodiments, the second air inlet 13 and the second air outlet 14 may be disposed at the second end of the housing 10 side by side. For example, the second air inlet 13 and the second air outlet 14 may be disposed along a width direction of the housing 10. The second air inlet 13 and the second air outlet 14 may be located at the same line and the same level. In some embodiments, the condenser unit 40 may be disposed between the second air inlet 13 and the second air outlet 14. The condenser unit 40 may be located inside the housing 10 and near the end of the second air inlet 13 and the second air outlet 14 in the housing 10. In some embodiments, the second air inlet 13 and the second air outlet 14 may be disposed along a height direction of the housing 10, and the second air inlet 13 and the second air outlet 14 may be located at the same vertical line.

In some embodiments, the first air inlet 11 and the first air outlet 12 may be juxtaposed. The first air outlet 12 may be disposed at an obliquely upward position relative to the first air inlet 11.

In some embodiments, because the first air outlet 12 is obliquely upward, the cooled air may be blown upward. There is a good angular difference between directions that the cooled air is blown out and the hot air enters into the first air inlet 11, which may form a regular indoor air circulation, and facilitate the air movement of the internal air circulation system, and get cooled indoor air rapidly. It may resolve the problems that the indoor air circulation is irregular and the heat exchange efficiency is low. In some embodiments, the first air inlet 11 and the first air outlet 12 may be disposed at the first end of the housing 10 side by side, and the first air outlet 12 may be disposed above the first air inlet 11. The first air inlet 11 and the first air outlet 12 may be disposed along the height direction of the housing 10, and they are located on the same vertical line. In some embodiments, the first air outlet 12 may be disposed obliquely on the housing 10, and form an upward inclination angle relative to the surface of the housing 10. The inclination angle may range from 30° to 40°. In some embodiments, an optimal inclination angle may be 35°. In some embodiments, the housing 10 may be obliquely disposed at a position where the first air outlet 12 is located, so that the inclined air outlet may be directly formed. In some embodiments, the first air outlet 12 may include an air-conditioning air outlet assembly. The air-conditioning air outlet assembly may be rotated up and down in order to achieve fine adjustment of the first air outlet 12. The rotation angle may be within a range of ±15°. In some embodiments, a temperature display module may be disposed on the first air outlet 12 for real-time display a current room temperature. The temperature display module may include an LED screen, a liquid crystal screen, a touch screen, or the like, or any combination thereof.

Figure 4:
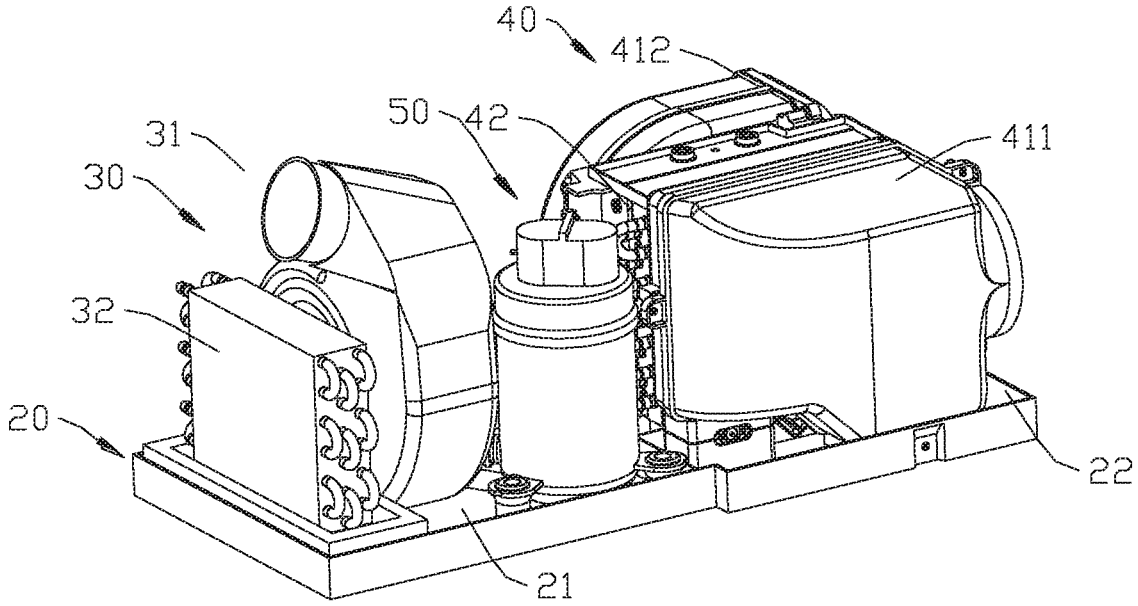
FIG. 4 is a schematic diagram illustrating an internal structure of a first angle of view of the air conditioner according to the embodiment of the present disclosure.
Figure 5:
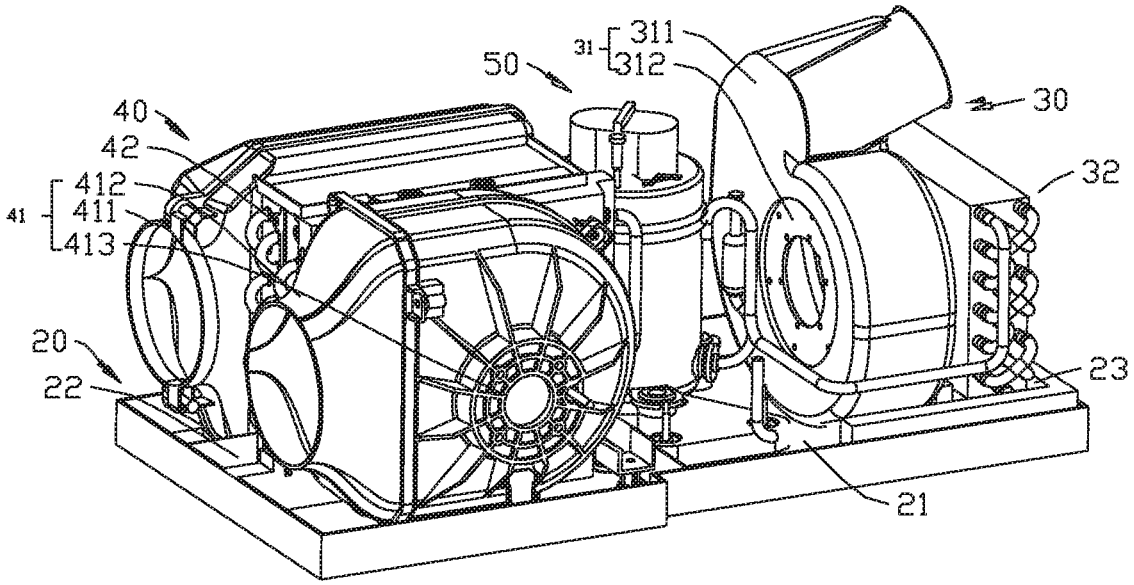
FIG. 5 is a schematic diagram illustrating an internal structure of a second angle of view of the air conditioner according to the embodiments of the present disclosure.
Figure 6:
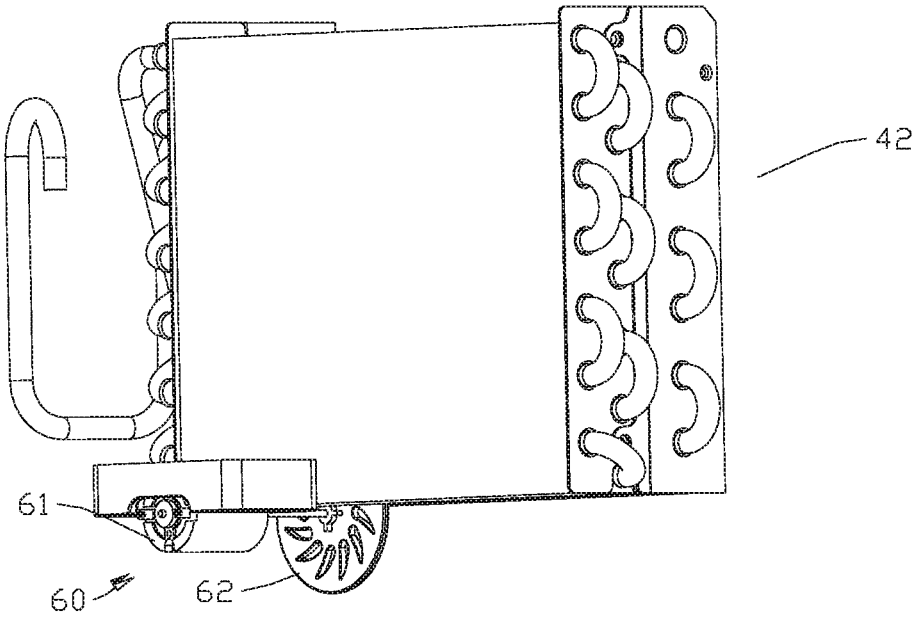
FIG. 6 is a schematic diagram illustrating a water stirring unit of an air conditioner according to the embodiment of the present disclosure.

FIG. 4 illustrates an internal structure of a first angle of view of the air conditioner according to the embodiment of the present disclosure. FIG. 5 illustrates an internal structure of a second angle of view of the air conditioner according to the embodiments of the present disclosure. FIG. 6 illustrates a water stirring unit of an air conditioner according to the embodiment of the present disclosure. As shown in FIGS. 4-6, the air conditioner may include a water stirring unit 60 disposed inside the housing 10. A first mounting groove 21 for mounting the evaporator unit 30 and a second mounting groove 22 for mounting the condenser unit 40 may be disposed on the inner bottom of the housing 10. The first mounting groove 21 may include a guiding groove or a guiding tube 23 for guiding the condensed water to the second mounting groove 22. The refrigerant may absorb the heat from air inside the evaporator unit 30. The water vapor in the air may be condensed to form the condensed water. The water stirring unit 60 may be disposed in the second mounting groove 22. The water stirring unit 60 may be located below the condenser unit 40 for stirring the condensed water in the second mounting groove 22 to form water beads, and spray the water bead to the condenser unit 40. The water beads may be discharged to the external air circulation system through the condenser unit 40. Specifically, during the refrigeration process, the refrigerant may absorb heat from air inside the evaporator unit 30, and further condense water vapor in the air. The condensed water may be formed accordingly. The guiding groove or the guiding tube 23 may export the condensed water to the second mounting groove 22. The water stirring unit 60 may stir the condensed water from the evaporator unit 30 to further form small water beads, and spray the small water beads to the condenser unit 40. In some embodiments, the small water beads may cool the condenser unit 40, and help the condenser unit 40 to dissipate heat. The heat dissipation efficiency of the condenser unit 40 may be improved. In some embodiments, the small water beads may become water vapor. The water vapor may be discharged to the external air circulation system via the airflow passing the condenser unit 40, which is beneficial to remove redundant condensed water generated during the refrigeration process. The water stirring unit 60 may be used to discharge the condensed water, which may resolve the problem caused by the drainage during the refrigeration process, and avoid or reduce the problems caused by complicate drainage structure in common air conditioner.

In some embodiments, the first mounting groove 21 may be disposed at the first end of the housing 10 (e.g., the front end). The second mounting groove 22 may be disposed at the second end of the housing 10 (e.g., the rear end). In some embodiments, the first mounting groove 21 and the second mounting groove 22 may include slot structures, removable mounting box structures, fast disassembly structures fixed by snap joints, cylinder structures being the same as shapes of bottoms of the evaporator unit and the condenser unit, or double layer structures having an inner groove and an outer groove. In some embodiments, the bottom of the first mounting groove 21 is higher than the bottom of the second mounting groove 22. In some embodiments, a central axis of the first mounting groove 21 may be the same as a central axis of the second mounting groove 22. In some embodiments, the central axis of the first mounting groove 21 may be different from the central axis of the second mounting groove 22. In some embodiments, the first mounting groove 21 and the second mounting groove 22 may be made of insulating materials. In some embodiments, waterproof materials may be coated on groove wall(s) of the first mounting groove 21 and the second mounting groove 22.

In some embodiments, the first mounting groove 21 may include a guiding groove 23 extending from the first mounting groove 21 toward the second mounting groove 22. The guiding groove 23 may be used to guide the condensed water to the second mounting groove 22. The second mounting groove 22 may include an opening for the condensed water led from the guiding groove 23. In some embodiments, the bottom of the first mounting groove 21 may have a step structure. Steps of the step structure may be arranged from high to low in the longitudinal direction of the first mounting groove 21. In some embodiments, the guiding groove 23 may be disposed at the lowest step. In some embodiments, the guiding groove 23 may have a closed structure. For example, the guiding groove 23 may include a cover for closing. The guiding groove 23 may have a multilaterally closed structure. There are openings for connecting to the first mounting groove 21 and the second mounting groove 22 at two ends of the guiding groove 23. The guiding groove 23 may include a metal groove and/or a plastic groove that have a rectangular or a cylindrical shape. The guiding groove 23 may be directly formed at the inner bottom of the housing 10. In some embodiments, the guiding groove 23 may include a semi-closed structure. The guiding groove 23 may include a metal groove and/or a plastic groove that have a rectangular shape, which are opening at the bottom and/or side walls. The guiding groove 23 may be directly formed at the inner bottom of the housing 10. In some embodiments, the guiding tube 23 may be disposed at one end of the first mounting groove 21. The guiding tube 23 may take away the heat in the air of the evaporator unit 30 so that the condensed water may be guided to the second mounting groove 22. The guiding tube 23 may include a closed tubular structure having a circular cross section. The guiding tube 23 may include two opening for connecting to the first mounting groove 21 and the second mounting groove 22. The guiding tube 23 may also include a partial tubular structure that is split at any angle along the axial direction.

In some embodiments, the water stirring unit 60 may be disposed in the second mounting groove 22. The water stirring unit 60 may be located below the condenser unit 40. The water stirring unit 60 may stir the condensed water in the second mounting groove 22 to form water bead to cool the condenser unit 40. Specifically, the water stirring unit 60 may stir the condensed water flowing from the evaporator unit 30 to form water beads. The water beads may be sprayed to the condenser unit 40 to cool the condenser unit 40 from various directions (e.g., from the bottoms or the sides). In some embodiments, after that the condensed water in the second mounting groove 22 is sprayed onto the condenser unit 40, the condenser unit 40 may perform heat exchange with the condensed water having a relatively low temperature. At least one portion of the condensed water may be vaporized to generate water vapor in order to take away the heat of surfaces of the condenser unit 40. When the second air inlet 13 continuously transmits the outdoor air to the condenser unit 40, a negative pressure zone may be formed in a region surrounding the condenser unit 40. The air, the water vapor and the heat in the negative pressure zone may be blown out from the second air outlet 14 and discharged to the outdoor.

In some embodiments, the water stirring unit 60 may include a driving mechanism 61 and a water wheel 62. The water wheel 62 may be coupled to the driving mechanism 61. The driving mechanism 61 may drive the water wheel 62 to rotate. The water wheel 62 may be disposed in the second mounting groove 22. Specifically, a driving mechanism 61 may be disposed at the bottom of the condenser unit 40. The driving mechanism 61 may drive the water wheel 62 to rotate, and the condensed water in the second mounting groove 22 may be dissipated. The small water beads may be detached from edges of the water wheel at a high speed, and evenly sprayed to the condenser unit 40 having a high temperature. When the condensed water is discharged, the heat of the condenser unit 40 may also be taken away, which may improve the heat exchange efficiency.

In some embodiments, the driving mechanism 61 may include a motor. The motor may drive the water wheel 62 to rotate. An output shaft of the motor may be coupled to a rotating shaft of the water wheel 62 for driving the water wheel 62 to rotate. In some embodiments, the motor may be a waterproof motor. A water blocking plate may be disposed between the motor and the water wheel, and used for the waterproof and supporting the shaft. The motor output shaft may penetrate the water blocking plate, and a bearing may be disposed at the penetrating portion. In some embodiments, the driving mechanism 61 may include a servo motor that drives the water wheel 62 to rotate. An output shaft of the servo motor may be coupled to the rotating shaft of the water wheel 62 for driving the water wheel 62 to rotate. In some embodiments, the servo motor may include a waterproof casing. A water blocking plate may be disposed between the servo motor and the water wheel, and used for the waterproof and supporting the shaft. The output shaft of the servo motor may penetrate the water blocking plate. A bearing may be disposed at the penetrating portion. It is easy to control, install and/or arrange, and overhaul the servo motor. In some embodiments, the driving mechanism 61 may include a direct current (DC) motor. The DC motor may drive the water wheel 62 to rotate. An output shaft of the DC motor may be coupled to the rotating shaft of the water wheel 62 for driving the water wheel 62 to rotate. In some embodiments, the DC motor may include a waterproof casing. A water blocking plate may be disposed between the DC motor and the water wheel 62, and used for the waterproof and supporting the shaft. The output shaft of the DC motor may penetrate the water blocking plate. A bearing may be disposed at the penetrating portion. The DC motor may be directly driven by the DC power. It is convenient for using the DC power. In some embodiments, the driving mechanism of the water stirring unit 60 may be driven by using a space vector pulse width modulation (SVPWM) technology. For the SVPWM, an inverter and the motor may be designated as a whole. According to a relationship between a magnetic flux and a voltage of the motor, a desired output voltage vector may be synthesized by using eight basic voltage vectors, so as to realize the frequency conversion speed regulation. There are some advantages for the utilization for the SVPWM technology drives the motor, for example, a high voltage utilization, good starting characteristics, and less harmonic components.

In some embodiments, the water wheel 62 may be disposed in the second mounting groove 22. The water wheel 62 may include a wheel body and a rotating shaft disposed on the axis of the wheel body. The rotating shaft may be disposed on two sidewalls of the second mounting groove 22 and connected to the two sidewalls of the second mounting groove 22. One end of the rotating shaft may be connected to the output shaft of the motor, which may be rotated by the motor, in order to drive the wheel body to rotate. In some embodiments, a groove structure may be disposed on the bottom of the second mounting groove 22. The middle portion of the groove structure is low, and two sides of the groove structure are high. The two sides of the bottom may include downwardly inclined smooth slopes. In some embodiments, the groove structure may include a smooth curved surface coupled to the water wheel shape. The bottom of the second mounting groove 22 may facilitate accumulation of the condensed water in the groove, so that the water wheel may stir enough condensed water to spray the water beads to the condenser unit 40.

In some embodiments, the evaporator unit 30 may include an evaporator 32 and a first centrifugal fan 31. The evaporator 32 may be disposed in the first mounting groove 21. The evaporator 32 may be disposed corresponding to the first air outlet 12. The first centrifugal fan 31 may be disposed between the evaporator 32 and the compressor unit 50. Specifically, the first centrifugal fan 31 may be disposed outside the first mounting groove 21, and disposed between the evaporator 32 and the compressor unit 50. The first centrifugal fan 31 may be configured to drawing in the indoor air through the first air inlet 11. The heat exchange may be performed by the refrigerant and the evaporator. Then the heat of the air in the evaporator may be taken away. The cooled air may be blown out from the first air outlet 12 by centrifugal rotation. The evaporator 32 may be disposed corresponding to the first air outlet 12, which may shorten a distance of the air channel between the evaporator 32 and the first air outlet 12, so that the heat exchange of the air channel becomes faster and more reasonable. The heat exchange effect and the heat exchange rate may be improved accordingly.

In some embodiments, the first centrifugal fan 31 may include a first casing 311, and a first impeller 312 disposed in the first casing 311. The first casing 311 may include an air inlet end that connects to the first air inlet 11, and an air outlet end that connects to the first air outlet 12. The air outlet end may be opposite to the evaporator 32. In some embodiments, a wind channel may be formed in the first casing 311. The air inlet end of the first casing 311 may connect to the first air inlet 11. The air outlet end of the first casing 311 may be opposite to the evaporator 32, and connect to the first air outlet 12. The indoor air may enter the first casing 311 from the first air inlet, and pass through the first impeller 312. The first impeller 312 may blow the indoor air from the air outlet end of the first casing 311 to the evaporator 32 for further heat exchange and cooling. The cooled air may be blown out from the first air outlet 12 for lowering the room air temperature. In some embodiments, the air outlet end of the first casing 311 may be opposite to the evaporator 32. The air may flow directly through the evaporator to remove the heat, and directly discharge the cooled air through the first air outlet 12, which may achieve a short air circulation, and a high efficient heat dissipation. In some embodiments, a first connection portion between the air outlet end of the first casing 311 and the evaporator 32, a second connection portion between the air inlet end of the first casing 311 and the first air inlet 11, and a third connection portion between the evaporator 32 and the first air outlet 12 may be sealed, for example, through a sealing tube, a sealing ring, a sealant, and so on, in order to ensure that the air channels may be independent and sealed.

In some embodiments, the condenser unit 40 may include a condenser 42 and a second centrifugal fan 41. The condenser 42 may be disposed in the second mounting groove 22, and the second centrifugal fan 41 and the condenser 42 may be arranged side by side. In some embodiments, the second centrifugal fan 41 may be disposed outside of the second mounting groove 22, and may be disposed side by side with the condenser 42. The second centrifugal fan 41 may be connected to the second air inlet 13 and the second air outlet 14. In some embodiments, the driving mechanism 61 in the water stirring unit 60 may drive the water wheel 62 to rotate, and stir the condensed water in the second mounting groove 22 to form small water beads. After that the small water beads are detached from the edge of the water wheel, the small water beads may be evenly sprayed to the condenser 42 having high temperature for further cooling the condenser 42. The small water beads may be vaporized to water vapor, and the outdoor air from the second air inlet 13 may take away the heat and the water vapor generated by the condensation 42. In some embodiments, the second centrifugal fan 41 and the condenser 42 may be arranged side by side, which may shorten a distance of outdoor air circulation path, and improve the heat exchange efficiency of the condenser.

In some embodiments, the second central fan 41 may include a second casing 411, a third casing 412 connected to the second casing 411, and an impeller 413 disposed in the third casing 412. The second casing 411 and the third casing 412 may be disposed inside of the housing 10 side by side. An air inlet end may be formed on an inner side of the second casing 411, an air outlet end may be formed on an inner side of the third casing 412. The second casing 411 may be connected to the second air inlet 13. The third casing 412 may be connected to the second air outlet 14. The condenser 42 may be disposed between the air inlet end of the second casing 411 and the air outlet end of the third casing 412. The water stirring unit 60 may be disposed at the bottom of the condenser 42. In some embodiments, the outdoor air may enter the second casing 411 from the second air inlet 13, and may be blown to the condenser 42 through the air inlet end of the second casing 411. The air may take away the heat generated by the condenser 42, and enter the third casing 412 through the air outlet end of the third casing 412. The impeller 413 may further blow out the air from the second air outlet 14. The structure of the second centrifugal fan 41 may shorten the outdoor air circulation route, and improve the heat exchange efficiency of the condenser. In some embodiments, a first connection portion between the second casing 411 and the second air inlet 13, a second connection portion between the third casing 412 and the second air outlet 14, a third connection portion between the condenser 42 and the second casing 411, and a fourth connection portion between the condenser 42 and the third casing 412 may be sealed, for example, through a sealing tube, a sealing ring, a sealant, and so on, in order to ensure that the air channels may be independent and sealed.

In some embodiments, the compressor unit 50 may include a DC variable frequency double cylinder rotor compressor. The compressor unit 50 may be connected to a circulation channel for a refrigerant cycle. The condenser unit 40 and the evaporator unit 30 may be successively wound around the circulation channel in the direction of the refrigerant cycle. Specifically, the circulation channel may be outside of the condenser unit 40 and the evaporator unit 30. The circulation channel may attach to surfaces of the condenser unit 40 and the evaporator unit 30. In order to increase heat dissipating area, the circulation channel may be bent outside the condenser unit 40 and the evaporator unit 30, such as a convoluted bend, a serpentine bend, and so on, for wrapping the condenser unit 40 and the evaporator unit 30. After absorbing the heat of the internal air from the evaporator unit 30, the refrigerant may be pressurized and driven by the compressor, and sent to the condenser unit 40. The condenser unit 40 may exchange heat with the refrigerant in the circulation channel, and take away the heat in the refrigerant. In some embodiments, the DC variable frequency double cylinder rotor compressor may be controlled by a DC 120°, 180° or 360° sine wave frequency conversion, which may improve a conveying efficiency of the refrigerant, a compression ratio, and a stability of the compression. Efficiency of heat absorption and absorption of the refrigerant may be improved. In some embodiments, the compressor unit 50 may also include a DC variable frequency scroll compressor. The DC variable frequency scroll compressor may smoothly adjust output cooling amount according to the needs of the environment, and reduce energy consumption caused by frequently start and stop. The compressor operation may become more energy efficient, and the refrigeration system may be operated stably. In some embodiments, the compressor unit 50 may also include a variable frequency screw compressor. The variable frequency screw compressor may have advantages of high compression speed of the cylinder air, low exhaust gas temperature, corrosion resistance, and low frequency of equipment maintenance, which may effectively reduce the energy consumption of the air conditioner and improve the operation efficiency. In some embodiments, the compressor may be a rotor compressor in a Qing'an brand, and its device model is FSC2-M028Y4.

In some embodiments, in the base 20, there are a DC battery pack for supplying power to the evaporator unit 30, the condenser unit 40, and the compressor unit 50. In some embodiments, an installation cavity may be disposed inside the base 20. The installation cavity may be closed by a cover plate or a sliding plate. The removable DC battery pack may be disposed in the installation cavity. The battery may be replaced in time according to actual conditions so as to ensure a service life and cooling effect of the air conditioner. In some embodiments, the DC battery pack may include a 24V DC battery, or a lithium ion battery, and so on. The DC battery pack may supply power to one or more components of the air conditioner. The components may include but not limited to an evaporator unit, a condenser unit, a compressor unit, and so on. In some embodiments, the DC battery pack may include a combination of a solar panel connected to the battery. The solar panel may convert solar energy into electrical energy based on a photoelectric effect or a photochemical effect, and store electrical energy in the battery. The battery may supply power to the evaporator unit 30, the condenser unit 40, and the compressor unit 50. In some embodiments, when the battery is low, an external power source may be configured to charge the battery, or the solar panel may be configured to charge the battery, so that the air conditioner may be stably operated. The solar panel may include a monocrystalline silicon solar panel, a polycrystalline silicon solar panel, an amorphous silicon solar panel, or the like, or any combination thereof. The battery may include a nickel-hydrogen battery, a nickel-cadmium battery, a lead-acid battery, a lithium ion battery, or the like, or any combination thereof. In some embodiments, the DC battery pack may be coupled with the base to form a battery base or power supply assembly.

In some embodiments, the base 20 may include a charge-discharge interface connected to the DC battery pack. A power supply interface may be disposed in a side of the bottom of the housing 10. In some embodiments, the charge-discharge interface may be connected to an external power source for charging. The charge-discharge interface may be connected to the power supply interface for supplying power for the evaporator unit 30, the condenser unit 40, and the compressor unit 50. In some embodiments, the DC battery pack may supply power to the first centrifugal fan 31 in the evaporator unit 30. The DC battery pack may supply power to the second central fan 41 in the condenser unit 40. The DC battery pack may supply power to the compressor in the compressor unit 50. The DC battery pack may supply power to the driving mechanism 61 in the water stirring unit 60. In some embodiments, the charge-discharge interface and the power supply interface may be connected by a connecting line, in this case, the DC battery pack may supply power to the evaporator unit 30, the condenser unit 40, and the compressor unit 50. In some embodiments, the number of the charge-discharge interface may be one or two, and even more. For example, assuming that there are two charge-discharge interfaces, a first charge-discharge interface may connect to the external power source, in order to charge the DC battery pack. At the same time, a second charge-discharge interface may connect to the power supply interface, in order to supply power to the evaporator unit 30, the condenser unit 40, and the compressor unit 50. In some embodiments, an installation cavity may be disposed on the bottom of the base 20. The DC battery pack may be detachably disposed in the installation cavity. The installation cavity may be closed by a cover plate or a sliding plate. In order to ensure a sealing condition, a waterproof sponge or a sealing ring may be disposed on periphery of the installation cavity in contact with the cover plate or the sliding plate, in order to prevent external water (e.g., rainwater) from splashing into the installation cavity to damage the DC battery pack. In some embodiments, a rubber gasket may be disposed surrounding the installation cavity in contact with the cover plate or the sliding plate. In some embodiments, the surfaces of the cover plate or the sliding plate may be covered with a waterproof coating, which ensures the use of the DC battery pack is safe and stable, and prevent the DC battery pack from contacting with water or water vapor.

In some embodiments, the power supply interface may be disposed on one side of the second air outlet 14 or the second air inlet 13. In some embodiments, the second air inlet 13, the second air outlet 14 and the condenser unit 40 may be connected to each other to form an external air circulation system. The power supply interface may be disposed on the end of the external circulation system. The end of the internal air circulation system may be located in indoor. The second air outlet and the second air inlet of the external air circulation system may be located in outdoor. The charge-discharge interface may be connected to the power supply interface through a connecting line, then the DC battery pack may provide power for the evaporator unit 30, the condenser unit 40, and the compressor unit 50. In some embodiments, one end of the circuit line may be placed in outdoor for avoiding an error touch of indoor person, and ensure the safety of the power supply. In some embodiments, the power supply interface and the charge-discharge interface may be waterproof. For example, surfaces of the power supply interface or the charge-discharge interface may be covered with a water-resistant coating. For another example, the power supply interface or the charge-discharge interface may be disposed in a waterproof safety box. The waterproof safety box may include a small hole for accommodate the connecting line. When the connecting line connects the charge-discharge interface and the power supply interface, the connecting line may be exposed outside. The safety of the utilization of the power supply may be ensured due to the waterproof safety box.

In some embodiments, an operating voltage of the DC battery pack may be 24V. The DC battery pack may include a 24V storage battery, or a 24V lithium battery. In some embodiments, the operating voltage of the compressor may be 24V. An accurate docking of the DC battery pack and the compressor operating voltage may be realized. The DC battery pack may supply power to the operation of the compressor. The compressor may be operated in corresponding frequency according to the set temperature. The power consumption of the air conditioner may be effectively reduced, and the energy saving may be achieved.

Figure 7:
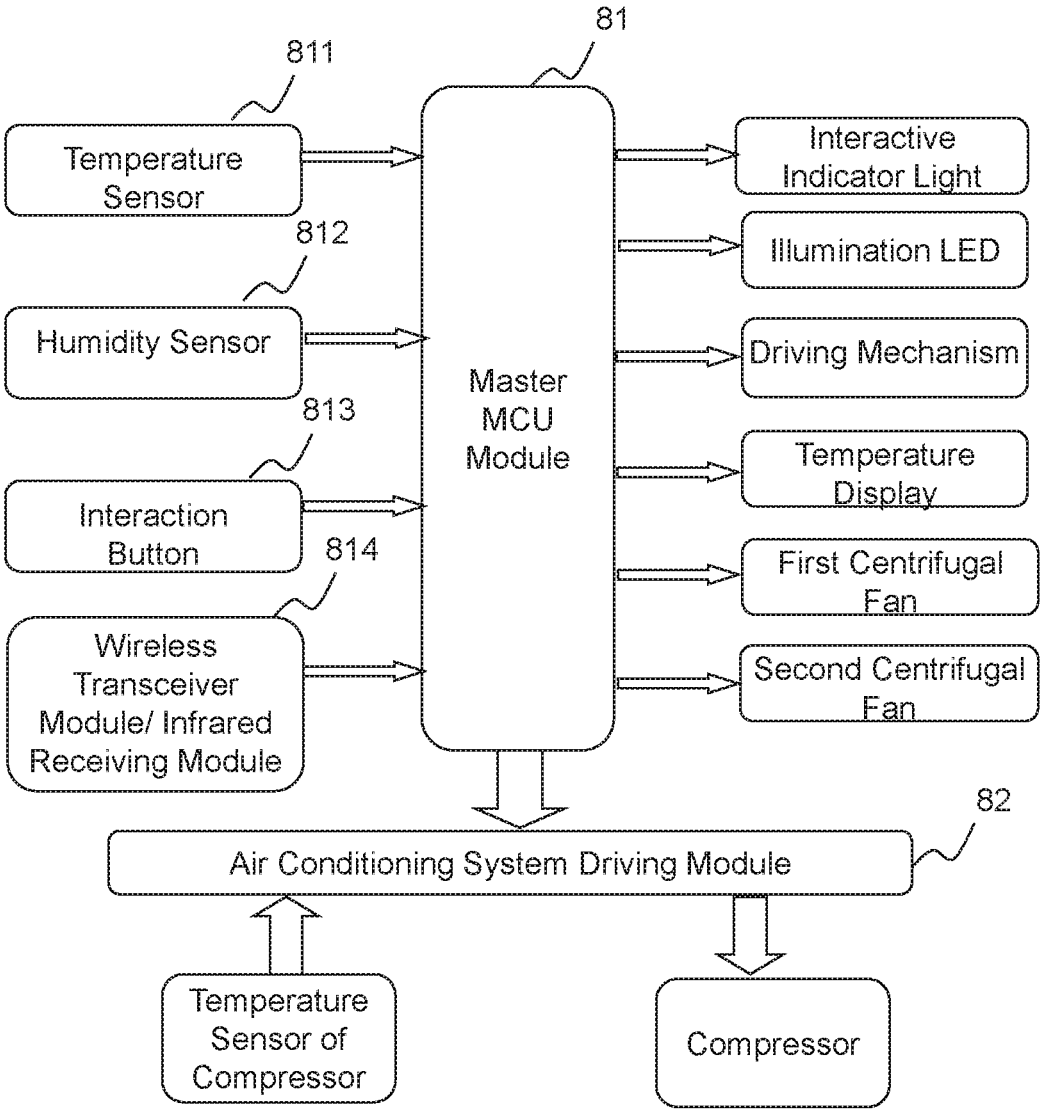
FIG. 7 is a schematic diagram illustrating a control system of an air conditioner according to some embodiments of the present disclosure.

FIG. 7 is a schematic diagram of a control system of an air conditioner according to some embodiments of the present disclosure. As shown in FIG. 7, the housing 10 may include a control panel carried with an integrated control system. The DC battery pack may be electrically connected to the integrated control system to supply power for the integrated control system. The evaporator unit 30, the condenser unit 40, and the compressor unit 50 may be electrically connected to the integrated control system. In some embodiments, the control panel may include but not limited to a control button (e.g., an on/off button, an operation mode control button, a temperature control button, a humidity control button, a timing button, an air speed control button, etc.), a display (e.g., a temperature display, a humidity display, etc.), an interactive indicator light (e.g., the indicator light is green when the power is on, the indicator light is not displayed when the power is off), an alarm light (e.g., the alarm light may flash when the battery is low), a lighting LED, a speaker, etc. In some embodiments, the integrated control system may include a master Microcontroller Unit (MCU) module 81, and an air conditioning system driving module 82 connected to the master MCU module 81. The master MCU module 81 may acquire one or more parameters collected by at least one of a temperature sensor 811, a humidity sensor 812, an interaction button 813, a wireless transceiver module/an infrared receiving module 814. The master MCU module 81 may generate a control signal for dynamically adjusting operations of components associated with the air conditioner by processing the one or more parameters. The components associated with the air conditioner may include but not limited to the evaporator 32 and the first centrifugal fan 31 of the evaporator unit 30, the condenser 42 and the second centrifugal fan 41 of the condenser unit 40, the driving mechanism 61 of the water stirring unit 60, the DC battery pack, the temperature display module at the first air outlet 12, the illumination LED, the interactive indicator light, and so on. For example, the master MCU module 81 may transmit a control signal to the temperature display module at the first air outlet 12. The temperature display module may display a current room temperature when the air conditioner works. The air conditioning system driving module 82 may be connected to the compressor and the temperature sensor of the compressor, and perform a DC 120° sine wave frequency conversion control for the compressor. In some embodiments, the air conditioning system driving module 82 may acquire the temperature information detected by the temperature sensor of the compressor. The air conditioning system driving module 82 may analyze the collected temperature information, and further control the operating power of the compressor. In some embodiments, the integrated control system may integrate an SVPWM program for controlling the speed of the driving mechanism 61 of the water stirring unit 60. For example, the device model of the master control MCU module of the integrated control system is R7F0C907B2DFP-C, and the device model of the air conditioning system driving module is TMS320F28027.

In some embodiments, the integrated control system may at least include a wireless transceiver module/an infrared receiving module 814 for transmitting and receiving wireless control signals or infrared control signals. For example, the wireless transceiver module may receive the wireless control signal from the mobile device and/or other wireless devices through a WIFI module or a Bluetooth module, and perform the setting of air conditioner functions. For another example, the infrared receiving module may receive the infrared control signal from an infrared remote controller of the air conditioner through the infrared receiving head, and perform the setting of the air conditioning functions. In some embodiments, the integrated control system may further include an audio module. The audio module may response to operations of the infrared remote control of the air conditioner, a mobile device, and/or other wireless devices. For example, the audio module may use a reminder sound to respond to the operation of the infrared remote controller of the air conditioner, the mobile device, and/or other wireless device. The audio module may notify, via an audio interaction mode, the user whether a function is turned on. The audio module may adjust the function of the air conditioner based on the audio input signal.

In some embodiments, the evaporator unit may include a temperature and humidity sensing system. The temperature and humidity sensing system may at least include a temperature sensor and a humidity sensor. The temperature sensor and the humidity sensor may be connected to the integrated control system signal. In some embodiments, the temperature sensor may detect and collect temperature information when the indoor air is passing through the first air inlet 11. The temperature sensor may detect and collect temperature information when the cooling air passing through the first air outlet 12. The humidity sensor may detect and collect humidity information when indoor air is passing through the first air inlet 11. In some embodiments, the temperature sensor 811, the humidity sensor 812, the interactive button 813, the wireless transceiver module, or the infrared receiving module 814 may be respectively connected to the master MCU module 81. The master MCU module 81 may acquire the temperature and humidity information collected by the temperature sensor 811 and the humidity sensor 812. The master MCU module 81 may send a control signal to display the temperature and humidity information on the control panel by processing the temperature and humidity information. The master MCU module 81 may acquire the temperature and/or humidity control information sent by the interactive button 813, the wireless transceiver module, or the infrared receiving module 814. The master MCU module 81 may analyze and process the control information, and perform temperature and/or humidity control for the indoor air blown from the first air inlet 11 to the evaporator 32. Then the air may be blown out from the first air outlet 12. The temperature of the air blown from the first air outlet 12 may be displayed on the control panel.

In some embodiments, the temperature sensors may include a first temperature sensor and a second temperature sensor. The first temperature sensor and the humidity sensor may be disposed in the first air inlet. The second temperature sensor may be disposed in the first air outlet. A temperature display module connected to the integrated control system may be disposed in a middle portion of the first air outlet. The temperature display module may be configured to display the temperature detected by the second temperature sensor. In some embodiments, the first temperature sensor and the humidity sensor may respectively perform temperature detection and humidity detection for indoor air blown from the first air inlet 11 to the evaporator 32. The master MCU module 81 may analyze and process the detected temperature and the humidity information. The second temperature sensor may detect temperature for the air blown from the first air outlet 12, and send the detected temperature information to the master MCU module 81 for further analyzing and processing. The master MCU module 81 may send a control signal to display the temperature information on the temperature display module by processing the temperature information.

In some embodiments, a plurality of battery external interfaces may be disposed in a side of the base. The plurality of battery external interfaces may be connected to the DC battery pack. The plurality of battery external interfaces may be connected to the external power source for charging. The plurality of battery external interfaces may be connected to the power supply interface to for the charging and discharging of the evaporator unit, the condenser unit, and the compressor unit. In some embodiments, the charge-discharge interface may be various types of the interfaces, for example, a USB interface, a two-hole socket, a round hole socket, and so on. In some embodiments, the power cord connecting the charge-discharge interface and the external power source may be applicable to various electronic devices or small household appliances, such as, a mobile phone, a computer, a speaker, a small kettle, a rice cooker, and so on. In some embodiments, the charge-discharge interface may be connected to the DC battery pack, and the DC battery pack may be connected to the main control MCU module 81 to supply power thereto. The master MCU module 81 may periodically detect the power of the DC battery pack to determine whether the DC battery pack needs to be charged, and generate a reminder signal.

Figure 8A:
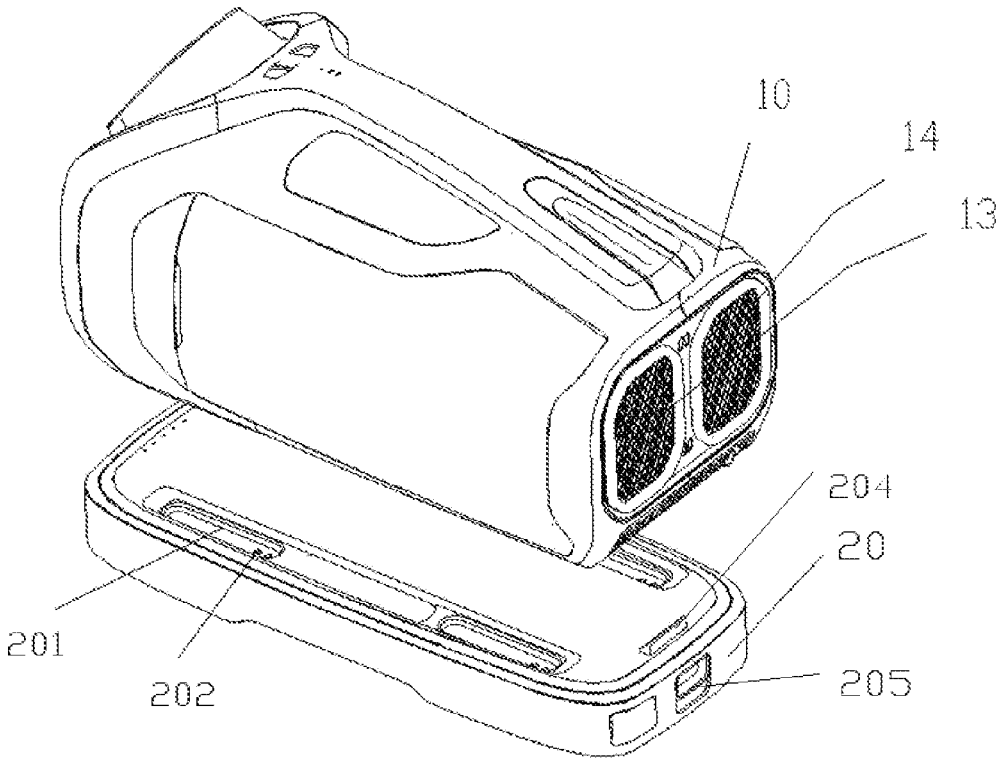
FIG. 8A is a schematic diagram illustrating a first perspective view of a connection structure of a base and an housing of an air conditioner according to some embodiments of the present disclosure.
Figure 8B:
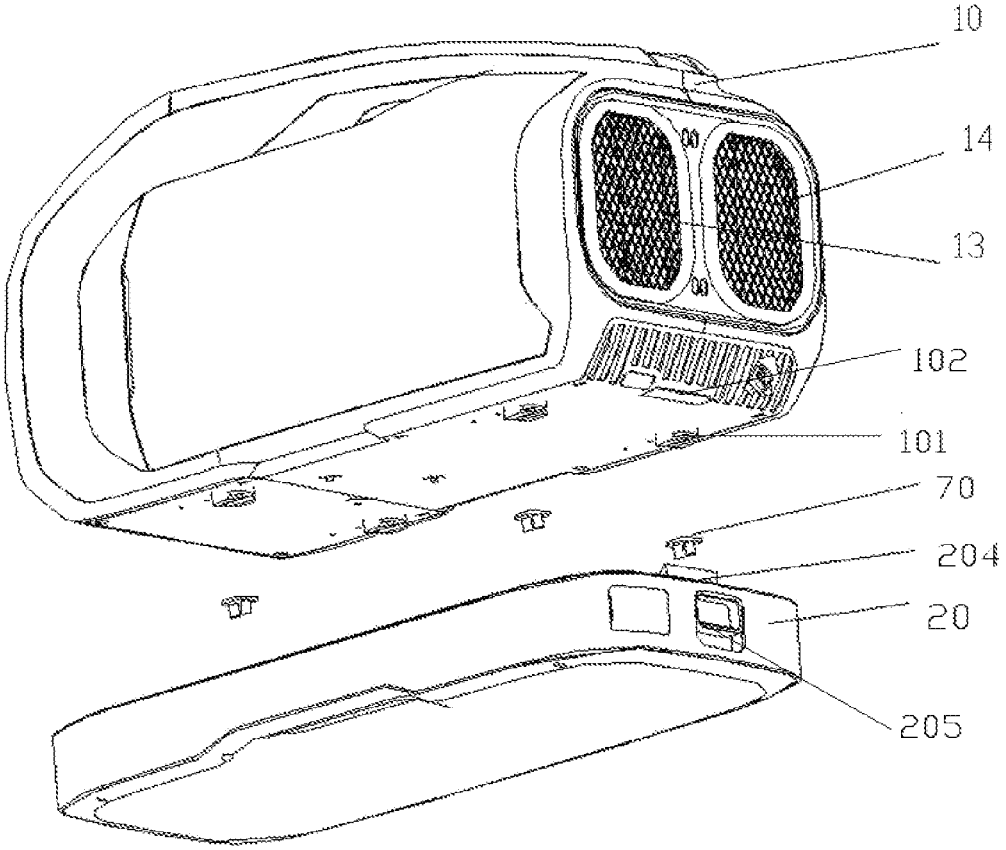
FIG. 8B is a schematic diagram illustrating a second perspective view of a connection structure of a base and an housing of an air conditioner according to some embodiments of the present disclosure.
Figure 8C:
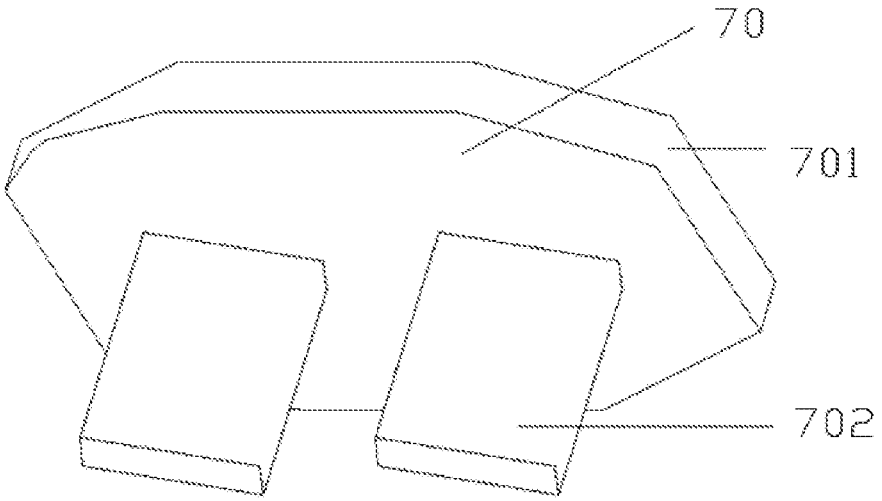
FIG. 8C is a schematic diagram illustrating a snapping connector of an air conditioner according to some embodiments of the present disclosure.
Figure 8D:
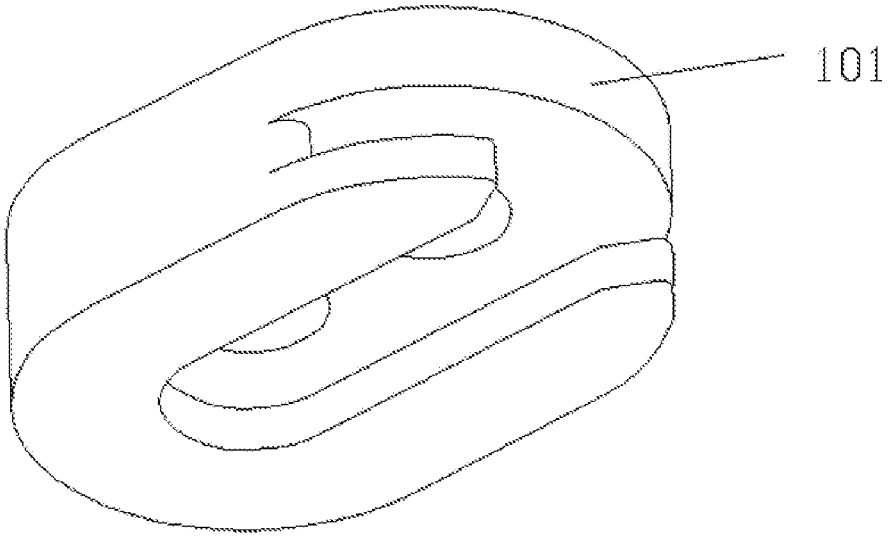
FIG. 8D is a schematic diagram illustrating a snapping holder of an air conditioner according to some embodiments of the present disclosure.
Figure 8E:
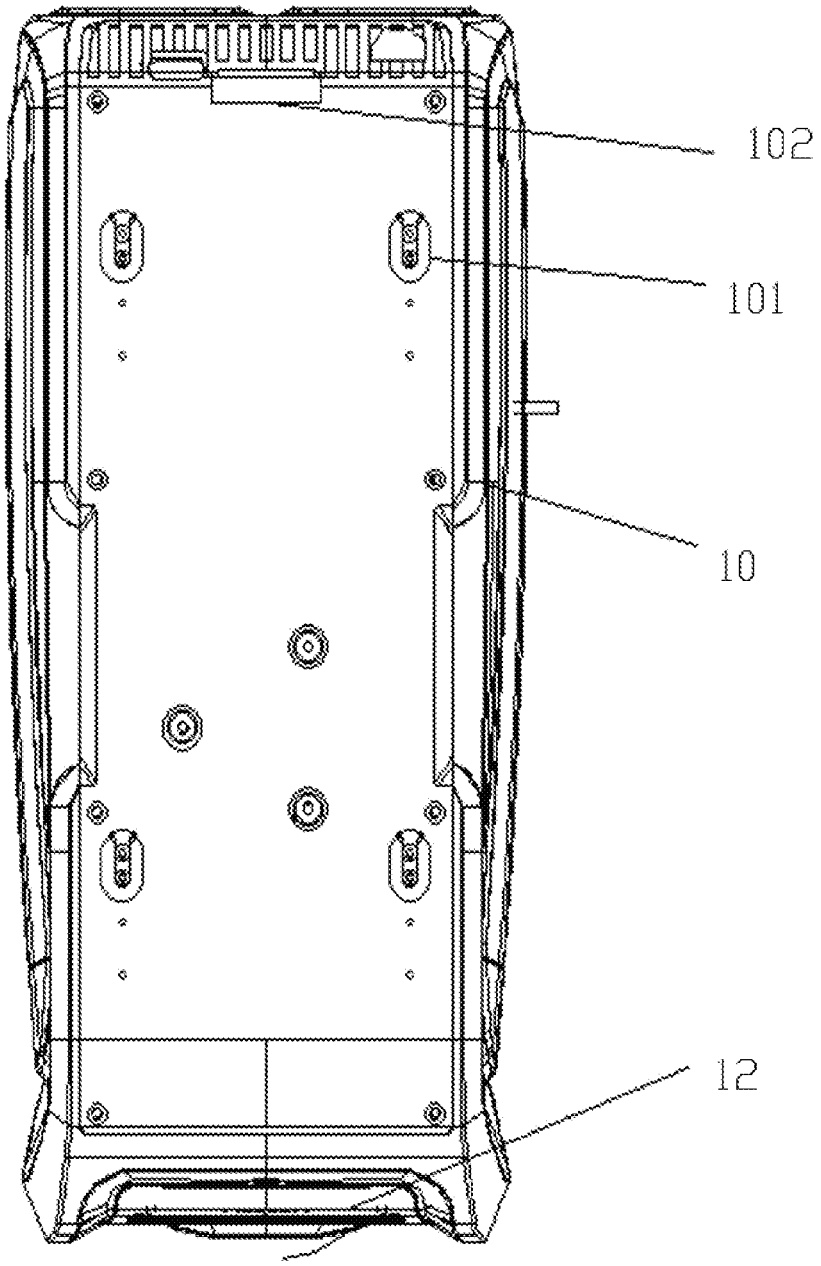
FIG. 8E is a schematic diagram illustrating an upward view of a housing of the air conditioner according to some embodiments of the present disclosure.
Figure 8F:
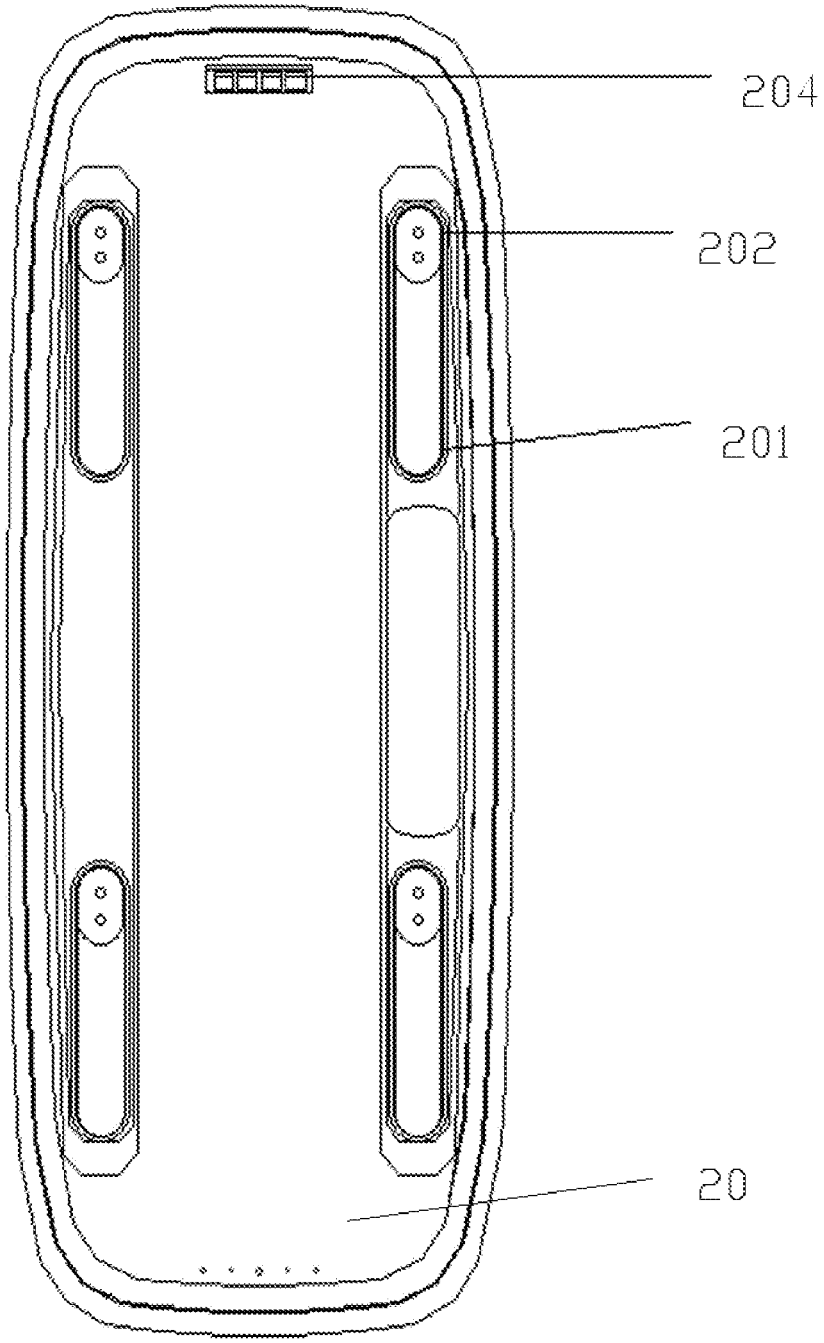
FIG. 8F is a schematic diagram illustrating a top view of a base of the air conditioner according to some embodiments of the present disclosure.

FIG. 8A is schematic diagram of a first perspective view of a connection structure of a base and an housing of the air conditioner according to some embodiments of the present disclosure, where the base and the housing are separated. FIG. 8B is schematic diagram of a second perspective view of a connection structure of the base and the housing of the air conditioner according to some embodiments of the present disclosure, where the base and the housing are separated. FIG. 8C is a schematic diagram of a snapping connector of an air conditioner according to some embodiments of the present disclosure. FIG. 8D is a schematic diagram of a snapping holder of an air conditioner according to some embodiments of the present disclosure. FIG. 8E is a schematic diagram of an upward view of the housing of the air conditioner according to some embodiments of the present disclosure. FIG. 8F is a schematic diagram of a top view of a base of the air conditioner according to some embodiments of the present disclosure. As shown in FIGS. 8A-8D, the base 20 may be detachably coupled to the housing 10. The detachable connection of the base 20 and the housing 10 may facilitate removing the base 20 and replacing the battery. When the base 20 and the housing 10 are connected, an integrated air conditioner may be formed. In some embodiments, if the base 20 of the air conditioner is damaged, it is convenient for the user to repair or replace the base 20 due to the detachable connection between the base 20 and the housing 10, which may avoid to maintain or replace an entire air conditioner.

In some embodiments, a snapping holder 101 and a snapping connector 70 connected to the snapping holder 101 may be disposed on the housing 10. A sliding groove 201 paired with the snapping holder 101 may be disposed on an upper portion of the base 20. A receiving portion 202 coupled with the snapping connector 70 may be disposed on the bottom of the sliding groove 201. In some embodiments, the snapping holder 101 may be disposed on the bottom of the housing 10. The snapping holder may couple with the snapping connector 70 due to a specific shape thereof, and connect to the base 20 through the snapping connector 70. In some embodiments, the snapping connector 70 may be an independent component. The upper portion of the snapping connector 70 may clamp with the snapping holder 101, and the lower portion of the snapping connector 70 may clamp with the receiving portion 202, thereby the housing 10 may be connected to the base 20. The snapping connector 70 may be a necessary intermediate component between the housing 10 and the base 20. In some embodiments, the sliding groove 201 may be disposed on the upper portion of the base 20. When the housing 10 and the base 20 are connected, the sliding groove 201 may act as a slide of the snapping connector 70 or the snapping holder 101, and limit a sliding position. The sliding groove 201 may enable that the snapping connector 70 connects to the receiving portion 202 accurately. In some embodiments, the receiving portion 202 may be located at one end of the bottom of the sliding groove 201 for matching the snapping connector 70. The housing 10 may slid along the sliding groove 201 until the snapping connector 70 and the receiving portion 202 are matched. The housing 10 may be attached to the base 20 via the snapping connector 70.

In some embodiments, if the housing 10 is connected to the base 20, the snapping connector 70 may be firstly connected to the receiving portion 202 disposed at one end of the sliding groove 201, and the sliding groove 201 may be disposed at the upper portion of the base 20. The snapping holder 101 disposed on the bottom of the housing 10 may be aligned with the sliding groove 201 disposed on the base 20. The entire housing 10 may slide toward the end of the receiving portion 202 and the snapping connector 70 until the snapping holder 101 matches the snapping connector 70. In this case, the housing 10 and the base 20 may be connected. In some embodiments, the snapping connector 70 and the snapping holder 101 may be paired and clamped in advance, and then the snapping holder 101 may be engaged with the sliding groove 201. The housing 10 may slide along the sliding groove 201 to the end of the receiving portion 202, so as that the receiving portion 202 may clamp with the snapping connector 70 for completing the connection of the housing 10 and the base 20. In some embodiments, if the housing 10 and the base 20 need to be detached, the housing 10 may firstly slide along the groove 201 to the end opposite to the end of the receiving portion 202. When sliding to the opposite end, the housing 10 may be lifted up and separated from the base 20. Then the receiving portion 202 and the snapping connector 70 may be detached. In this case, the process of disassembling the housing 10 and the base 20 may be completed.

In some embodiments, a height of the snapping holder 101 may be less than or equal to the height of the sliding groove 201, a width of the snapping holder 101 may be less than or equal to the width of the sliding groove 201. Therefore, the snapping holder 101 may slide into the sliding groove 201 as a whole, and match with the receiving portion 202 through the snapping connector 70. In some embodiments, at least one snapping holder 101 may be set. In certain embodiments, four snapping holders 101 may be set. For example, the snapping holder 101 may be located on both sides of the bottom of the housing 10, and two snapping holders 101 may be disposed on each side. In some embodiments, the number of the snapping connector 70 and the sliding groove 201 may be same as the number of the snapping holder 101. The position of the sliding groove 201 at the base 20 may correspond to the position of the snapping holder 101 at the bottom of the housing 10, so as that the snapping holder 101 and the receiving portion 202 of the sliding groove 201 may be paired by the snapping connector 70.

In some embodiments, the snapping connector 70 may include a snapping plate 701 connected to the snapping holder 101, and a snapping portion 702 attached to a side of the snapping plate 701. The snapping portion 702 may clamp with the receiving portion 202. In some embodiments, the shape of the snapping plate 701 and the shape of the snapping portion 702 of the snapping connector 70 may be matched with each other. The snapping connector 70 may match with the snapping holder 101, and the snapping portion 702 may match with the receiving portion 202 on the sliding groove 201. In some embodiments, the snapping plate 701 may include a smooth flat plate having a specific shape. At least one portion of the snapping plate 701 may be inserted into the snapping holder 101. A least one portion of the snapping portion 702 that is not connected to the snapping plate 701 may match with the receiving portion 202. The portion connected to the snapping plate 701 may be inserted into the snapping holder 101. In some embodiments, the snapping portion 702 may be connected to the snapping plate 701 to form a complete snapping connector 70. The snapping holder 101 and the receiving portion 202 may be connected by the snapping connector 70. The housing 10 and the base 20 may be connected. In some embodiments, the snapping portion 702 and the snapping plate 701 may be joined together by various means, for example, bonding, screwing (e.g., bolting, screwing, self-tapping screw, fastener-assembly connection, etc.), pinning, welding, fastening, etc. In some embodiments, an angle of the connection between the snapping portion 702 and the snapping plate 701 may be vertical or inclined. The shape or angle of the connection may be changed corresponding to different connection modes. In some embodiments, the structure of the snapping portion 702 may include an elastic buckle, a permanent magnet, and so on.

In some embodiments, the snapping holder 101 may be open on the side and concavely form an open groove. The snapping holder 101 may include a notch at a bottom of the open groove. The snapping plate 701 may be inserted into the open groove through a side opening of the snapping holder 101. The snapping portion 702 may be protruded from the notch. In some embodiments, when the housing 10 needs to be connected to the base 20, the snapping connector 70 may be connected to the receiving portion 202. Then, the housing 10 and the snapping holder 101 may be slid. The snapping plate 701 of the snapping connector 70 may be inserted along the side open groove of the snapping holder 101. The snapping portion 702 may be inserted along the notch at the bottom of the snapping holder 101. A portion of snapping portion of the snapping portion 702 and the receiving portion 202 may be protruded from the notch. In some embodiments, the shape of the snapping holder 101 may match with the shape of the snapping connector 70, thereby connecting the housing 10 and the base 20.

In some embodiments, the snapping portion 702 may include at least one cylinder. The receiving portion 202 may include at least one circular hole that cooperates with the cylinder to achieve a shaft-hole matching. In some embodiments, the snapping portion 702 may be connected to the snapping plate 701. The portion of the snapping portion 702 connected to the snapping plate 701 may be located at the bottom of the open groove of the snapping holder 101 when the snapping connector 70 is connected to the snapping holder 101. The portion of snapping portion 702 connected to the receiving portion 202 may be protruded from the notch at the bottom of the open groove, and matched with the shape of the receiving portion 202. The snapping holder 101 and the receiving portion 202 may be connected. The housing 10 and the base 20 may be connected. In some embodiments, the snapping portion 702 may include at least one cylinder. In some embodiments, the number of cylinders may be two, and the two cylinders may be arranged side by side. In some embodiments, if there are two cylinders included in the snapping portion 702, thus two circular holes need to be set in corresponding position of the receiving portion 202. The snapping portion 702 and the receiving portion 202 may be matched by the shaft-hole matching, so that the snapping portion 702 is not easily loosened or slipped out after being snapped with the receiving portion 202, and the connection is more stable. In some embodiments, the diameter of the snapping portion 702 may be slightly larger than the diameter of the receiving portion 202, and an interference fit may be used to stabilize the connection.

In some embodiments, the air conditioner may include a positioning clamping assembly 71 for positioning and clamping the housing 10 and the base 20. In some embodiments, due to the detachable connection of the housing 10 and the base 20, the housing 10 and the base 20 may be not positioned and clamped accurately. The positioning clamping assembly 71 may be configured to achieve the positioning and clamping, so that the housing 10 and the base 20 may be connected accurately and closely.

In some embodiments, the positioning clamping assembly 71 may include a positioning groove 102 disposed at the bottom of the housing 10, and an adjustable positioning assembly 203 disposed on the base 20. The adjustable positioning assembly 203 may include a positioning block 203, an adjustment plate 204, and a torsion spring assembly for connecting the positioning block 203 and the adjustment plate 204. The positioning block 203 may be located at an upper portion of the base 20. The positioning block 203 may be extended or retracted into interior of the base 20 for engaging with the positioning groove 102 to achieve clamping or disengagement from the positioning groove 102 to release the clamping. The adjustment plate 204 may be located on one side of the base 20, and may be pushed up and down, and control the torsion spring assembly to drive the positioning block 203 into the interior of the base 20. In some embodiments, an initial state of the positioning block 203 is extended from the upper end of the base 20. The torsion spring assembly may be configured to connect the positioning block 203 and the adjustment plate 204 for implementing the linkage of the positioning block 203 and the adjustment plate 204. The torsion spring assembly may provide a clamping force for the positioning block 203 and the positioning groove 102 to achieve a tightened clamping.

In some embodiments, when sliding the housing 10 for connecting the snapping holder 101 and the snapping connector 70 connected to the receiving portion 202, the adjustment plate 204 may be pressed down to retract the positioning block 203 into the interior of the base 20 by the torsion spring assembly. When the snapping holder 101 and the snapping connector 70 are successfully matched, the downwardly pressing adjustment plate 204 may be loosened, and the positioning block 203 may, by an elastic force of the torsion spring assembly, be extended from the interior of the base 20 in order to engage with the positioning groove 102 at the bottom of the housing 10. The clamping between the housing 10 and the base 20 may be achieved. When it desires to disassemble the housing 10 and the base 20, the adjustment plate may be pressed down. The positioning block 203 may be retracted into the base 20 by the torsion spring assembly. The housing 10 may be slid along the direction opposite to the direction of matching the snapping holder 101 and the snapping connector 70, then the clamping of the snapping holder 101 and the snapping connector 70 may be released. In some embodiments, the positioning clamping assembly 71 may avoid that the housing 10 and the base 20 are unfastened due to an accidental sliding of the housing 10. Only if the adjustment plate is pressed down, the housing 10 may be slid away from the base 20. In some embodiments, the torsion spring assembly may include a rotating mechanism having a torsion spring. For example, a cavity, disposed inside of the base 20, may be used to place the torsion spring assembly. A fixed shaft is disposed. The torsion spring may be sleeved on the fixed shaft. The ends of the torsion spring may be respectively connected to the adjustment plate 204 and the positioning block 203. It should be noted that various structures that have the same or similar function may be used.

In some embodiments, the positioning groove 102 and the adjustment plate 204 may be disposed on the side of the second air outlet 14. Because the second air outlet 14 may be usually disposed in outdoor, which may avoid or reduce the problem that the clamping is removed due to a misoperation.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "unit," "module," or "system." Furthermore, aspects of the present disclosure may take the form of a computer program product embodied in one or more computer readable media having computer readable program code embodied thereon.

Computer program code for carrying out operations for aspects of the present disclosure may be written in any combination of one or more programming languages, including an object oriented programming language such as Java, Scala, Smalltalk, Eiffel, JADE, Emerald, C++, C#, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

In some embodiments, the numbers expressing quantities or properties used to describe and claim certain embodiments of the application are to be understood as being modified in some instances by the term "about," "approximately," or "substantially." For example, "about," "approximately," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

I claim:

1. An air conditioner, having a housing disposed on a base, and the housing houses an evaporator unit, a condenser unit, and a compressor unit, comprising a first air inlet and a first air outlet located on a first end of the housing, and the first air inlet, the first air outlet and the evaporator are connected to each other to form an internal air circulation system;

a second air inlet and a second air outlet located on a second end of the housing, and the second air inlet, the second air outlet and the condenser unit are connected to each other to form an external air circulation system;

wherein airways of the internal air circulation system and the external air circulation system are independent from each other; and the second end is opposite to the first end;

the base further includes a DC battery pack for supplying power to the evaporator unit, the condenser unit, and the compressor unit; and a charge-discharge interface connected to the DC battery pack is disposed on a side of the base, and a power supply interface is disposed on a side of a bottom of the housing.

2. The air conditioner of claim 1, wherein the evaporator unit is disposed at an end of the first air inlet or the first air outlet at the first end of the housing, and the condenser unit is disposed at an end of the second air inlet or the second air outlet at the second end of the housing.

3. The air conditioner of claim 1, wherein:

the second air inlet and the second air outlet are juxtaposed, and the condenser unit is disposed between the second air inlet and the second air outlet; and the first air inlet and the first air outlet are juxtaposed, the first air outlet being disposed above the first air inlet at an obliquely upward position relative to the first air inlet.

4. The air conditioner of claim 1, further includes:

a water stirring unit disposed inside the housing;

a first mounting groove for mounting the evaporator unit, a second mounting groove for mounting the condenser unit, the first mounting groove and the second mounting groove are disposed on an inner bottom of the housing;

a guiding groove or a guiding tube, disposed at one end of the first mounting groove, which discharges condensed water to the second mounting groove, wherein when a refrigerant absorbs heat from air inside the evaporator unit, water vapor in the air is condensed to form the condensed water;

the water stirring unit is disposed in the second mounting groove and under the condenser unit; and the water stirring unit is configured to stirring the condensed water in the second mounting groove to form water beads, and spray the water beads to the condenser unit, wherein the condenser unit discharges the water beads to the external air circulation system.

5. The air conditioner of claim 4, wherein the water stirring unit includes a driving mechanism connectedly to drive a water wheel to rotate, wherein the water wheel is disposed in the second mounting groove.

6. The air conditioner of claim 4, wherein the evaporator unit includes an evaporator and a first centrifugal fan, the evaporator being positioned in the first mounting groove corresponding to the first air outlet, and the first centrifugal fan being disposed between the evaporator and the compressor unit.

7. The air conditioner of claim 6, wherein the first centrifugal fan includes a first casing and a first impeller disposed in the first casing, the first casing including an air inlet end and an air outlet end, wherein the air inlet end connects to the first air inlet, the air outlet end connects to the first air outlet, and the air outlet end is opposite to the evaporator.

8. The air conditioner of claim 4, wherein the condenser unit includes a condenser disposed in the second mounting groove and a second centrifugal fan, the condenser and the second centrifugal fan being juxtaposed.

9. The air conditioner of claim 8, wherein the second centrifugal fan includes a second casing, a third casing connected to the second casing, and a second impeller disposed in the third casing;

wherein the second casing and the third casing are disposed inside the housing side by side, an air inlet end is formed on an inner side of the second casing, an air outlet end is formed on an inner side of the third casing, the second casing is connected to the second air inlet, the third casing is connected to the second air outlet, the condenser is disposed between the air inlet end of the second casing and the air outlet end of the third casing, and the water stirring unit is disposed on a bottom of the condenser.

10. The air conditioner of claim 1, wherein the compressor unit includes a direct current (DC) variable frequency double cylinder rotor compressor.

11. The air conditioner of claim 1, wherein the charge-discharge interface is connected to an external power source for charging, or is connected to the power supply interface for supplying power for the evaporator unit, the condenser unit, and the compressor unit.

12. The air conditioner of claim 1, wherein an operating voltage of the DC battery pack is 24V.

13. The air conditioner of claim 1, further comprising a control panel disposed on the housing, wherein an integrated control system being integrated to the control panel and the DC battery pack is electrically connected to the integrated control system and supplies power for the integrated control system; and the evaporator unit, the condenser unit, and the compressor unit are electrically connected to the control panel.

14. The air conditioner of claim 13, wherein the evaporator unit further includes a temperature and humidity sensing system, the temperature and humidity sensing system at least including a temperature sensor and a humidity sensor, and the temperature sensor and the humidity sensor are connected to the integrated control system signally.

15. The air conditioner of claim 14, wherein the temperature sensor includes a first temperature sensor and a second temperature sensor, the first temperature sensor and the humidity sensor being disposed inside the first air inlet, the second temperature sensor being disposed inside the first air outlet; and a temperature display module, disposed in a middle portion of the first air outlet and connected to the integrated control system signally, is configured to display a temperature detected by the second temperature sensor.

16. An air conditioner, having a housing disposed on a base, and the housing houses an evaporator unit, a condenser unit, and a compressor unit, comprising a first air inlet and a first air outlet located on a first end of the housing, and the first air inlet, the first air outlet and the evaporator are connected to each other to form an internal air circulation system;

a second air inlet and a second air outlet located on a second end of the housing, and the second air inlet, the second air outlet and the condenser unit are connected to each other to form an external air circulation system;

wherein airways of the internal air circulation system and the external air circulation system are independent from each other; and the second end is opposite to the first end;

a bottom of the housing includes a snapping connector;

an upper portion of the base includes a receiving portion coupled to the snapping connector; and the housing is detachably coupled to the base by using the snapping connector and the receiving portion.

17. The air conditioner of claim 16, wherein:

the bottom of the housing includes a snapping holder connected to the snapping connector;

the upper portion of the base includes a sliding groove paired with the snapping holder, and a bottom of the sliding groove includes the receiving portion coupled to the snapping connector.

18. The air conditioner of claim 17, wherein the snapping connector includes a snapping plate coupled to the snapping holder, and a snapping portion attached to a side of the snapping plate, the snapping portion snappily connecting to the receiving portion.

19. The air conditioner of claim 18, wherein:

the snapping holder is open on the side and concavely formed with an open groove;

the snapping holder includes a notch at a bottom of the open groove; and the snapping plate is inserted into the open groove through a side opening of the snapping holder, and the snapping portion is protruded from the notch.

20. The air conditioner of claim 19, further includes a positioning clamping assembly for positioning and clamping the housing and the base, the positioning clamping assembly including a positioning groove disposed on the bottom of the housing, and an adjustable positioning assembly disposed on the base;

wherein the adjustable positioning assembly includes a positioning block, an adjustment plate, and a torsion spring assembly for connecting the positioning block and the adjustment plate; the positioning block being disposed at an upper portion of the base, and extended out of or retracted into interior of the base for engaging with the positioning groove to achieve clamping or disengagement from the positioning groove to release the clamping; the adjustment plate being disposed on a second side of the base, and pushed up and down to drive the positioning block into the interior of the base; the torsion spring assembly being configured to connect the positioning block and the adjustment plate for implementing the linkage of the positioning block and the adjustment plate, and providing a clamping force for the positioning block and the positioning groove to achieve clamping.

* * * * *